US007252370B2

(12) United States Patent
Hirota

(10) Patent No.: US 7,252,370 B2
(45) Date of Patent: Aug. 7, 2007

(54) INKJET PRINTING HEAD

(75) Inventor: Atsushi Hirota, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 257 days.

(21) Appl. No.: 10/879,008

(22) Filed: Jun. 30, 2004

(65) Prior Publication Data

US 2005/0024442 A1 Feb. 3, 2005

(30) Foreign Application Priority Data

Jun. 30, 2003 (JP) ..... 2003-187548

(51) Int. Cl.
*B41J 2/045* (2006.01)

(52) U.S. Cl. ..... 347/68; 347/65

(58) Field of Classification Search ..... 347/68, 347/69, 70, 71, 72, 65, 40, 43
See application file for complete search history.

(56) References Cited

U.S. PATENT DOCUMENTS

| | | | |
|---|---|---|---|
| 4,104,646 | A | 8/1978 | Fischbeck et al. |
| 5,880,763 | A | 3/1999 | Tanaka et al. |
| 5,963,234 | A | 10/1999 | Miyazawa et al. |
| 6,042,222 | A | 3/2000 | Moritz, III et al. |
| 6,364,467 | B1 | 4/2002 | Blair et al. |
| 6,648,452 | B2 | 11/2003 | Ito |

FOREIGN PATENT DOCUMENTS

| | | |
|---|---|---|
| EP | 0 759 361 A2 | 8/1996 |
| EP | 1 024 003 A2 | 8/2000 |
| EP | 1 160 084 A1 | 12/2001 |
| EP | 1 316 426 A1 | 6/2003 |
| JP | A 55-071569 | 5/1980 |
| JP | A 4-179549 | 6/1992 |
| JP | A 09-314836 | 12/1997 |
| JP | 2002-137386 | 5/2002 |
| JP | B2 3329801 | 7/2002 |

*Primary Examiner*—Lamson Nguyen
(74) *Attorney, Agent, or Firm*—Oliff & Berridge, PLC

(57) ABSTRACT

An inkjet printing head includes: an actuator unit; and a flow path unit onto whose surface the actuator unit is fixed, the flow path unit including: a common ink chamber having a plurality of outlets; a plurality of individual ink flow paths having a plurality of pressure chambers of which the volumes are changed by the actuator unit, the individual ink flow paths for leading ink from the respective outlets of the common ink chamber to respective nozzles through respective pressure chambers, the pressure chambers arranged along a plane in a form of matrix and each connected to the respective nozzles; and a plurality of adjustment portions provided at a side opposite to the actuator unit with respect to the pressure chambers and adjust compliances of each of the pressure chambers to be equalized.

32 Claims, 17 Drawing Sheets

INKJET PRINTING HEAD

BACKGROUND OF THE INVENTION

1. Field of the Invention

The present invention relates to an inkjet printing head for ejecting ink onto a recording medium to thereby perform printing.

2. Description of the Related Art

An inkjet printing head has been described in JP-A-9-314836 (see FIGS. 1 and 2). In the inkjet printing head, ink from a common ink chamber is distributed into a plurality of pressure chambers, that is, pressure generation chambers arranged along a direction. In the inkjet printing head, an actuator unit including a piezoelectric vibration plate is stuck to a flow path unit in which the common ink chamber and nozzles are formed. When pressure generated by the piezoelectric vibration plate is applied to ink in any pressure chamber selected from the plurality of pressure chambers, ink is ejected from a nozzle connected to the selected pressure chamber. Cavities are provided in portions between the common ink chamber and the pressure chambers in the flow path unit so that the cavities can suppress crosstalk in which vibration generated in a pressure chamber is transmitted to the common ink chamber to induce change in pressure in the other pressure chambers. In the inkjet printing head described in JP-A-9-314836, all the pressure chambers are opposite to the common ink chamber, so that the positional relation between the common ink chamber and each pressure chamber is common to all the pressure chambers. In addition, the shape of each cavity is common to all the pressure chambers.

SUMMARY OF THE INVENTION

To attain improvement in print resolution and print speed, the pressure chambers have been recently tried to be arranged in the form of a matrix along a plane, that is, to be arranged two-dimensionally along two directions. In this case, the common ink chamber cannot be provided opposite to all the pressure chambers because it is necessary to provide nozzles to eject ink in a direction perpendicular to the plane along which the pressure chambers are arranged. Accordingly, the pressure chambers are inevitably classified into two types, namely, the type opposite to the common ink chamber and the type not opposite to the common ink chamber. Among the two types of pressure chambers, the pressure chambers of the type opposite to the common ink chamber exhibit relatively large compliance (reciprocal of rigidity) in an ink ejection operation whereas the pressure chambers of the type not opposite to the common ink chamber exhibit relatively small compliance in an ink ejection operation. The difference in compliance is expressed as a difference in ink ejection speed and brings a cause of deterioration in image quality.

Therefore, one of objects of the invention is to provide an inkjet printing head in which the difference in compliance between pressure chambers due to the difference in positional relation between each pressure chamber and a common ink chamber can be compensated for so that the speed of ink ejected from nozzles can be made uniform.

According to a first aspect of the invention, there is provided an inkjet printing head including: an actuator unit; and a flow path unit onto whose surface the actuator unit is fixed, the flow path unit including: a common ink chamber having a plurality of outlets; a plurality of individual ink flow paths having a plurality of pressure chambers of which the volumes are changed by the actuator unit, the individual ink flow paths for leading ink from the respective outlets of the common ink chamber to respective nozzles through respective pressure chambers, the pressure chambers arranged along a plane in a form of matrix and each connected to the respective nozzles; and a plurality of adjustment portions provided at a side opposite to the actuator unit with respect to the pressure chambers and adjust compliances of each of the pressure chambers to be equalized.

According to a second aspect of the invention, there is provided an inkjet printing head including: an actuator unit; and a flow path unit onto whose surface the actuator unit is fixed, the flow path unit including: a plurality of nozzles for ejecting ink, which are classified into four groups of a first through fourth nozzles; a common ink chamber having a plurality of outlets; a plurality of individual ink flow paths having a plurality of pressure chambers of which the volumes are changed by the actuator unit, the individual ink flow paths for leading ink from the respective outlets of the common ink chamber to the respective nozzles through respective pressure chambers, the pressure chambers arranged along a plane in a form of matrix and each connected to the respective nozzles; and a plurality of adjustment portions provided at a side opposite to the actuator unit with respect to the pressure chambers and adjust compliances of each of the pressure chambers to be equalized, wherein each of the pressure chambers are formed in a substantially quadrilateral flat shape having acute-angled portions diagonally, one of which is connected to one of the nozzles, and the pressure chambers are aligned in columns of a first through fourth pressure chamber columns extending in parallel to one another, wherein the common ink chamber includes first and second common ink flow paths extending in parallel to each other in a direction parallel to the pressure chamber columns, wherein in the pressure chambers included in the first pressure chamber column, one of the acute-angled portions is connected to the first common ink flow path and the other of the acute-angled portions is connected to one of the first nozzles, wherein in the pressure chambers included in the second pressure chamber column, one of the acute-angled portions that is adjacent to the one of the acute-angled portions in the first pressure chamber column and opposed to the pressure chambers of the first pressure chamber column, is connected to the first common ink flow path and the other of the acute-angled portions is connected to one of the second nozzles, wherein in the pressure chambers included in the third pressure chamber column, one of the acute-angled portions that is adjacent to the other of the acute-angled portions in the second pressure chamber column and opposed to the pressure chambers of the second pressure chamber column, is connected to one of the third nozzles and the other of the acute-angled portions is connected to the second common ink flow path, wherein in the pressure chambers included in the fourth pressure chamber column, one of the acute-angled portions that is adjacent to the other of the acute-angled portions in the third pressure chamber column and opposed to the pressure chambers of the third pressure chamber column, is connected to one of the fourth nozzles and the other of the acute-angled portions is connected to the second common ink flow path, and wherein the adjustment portions are provided along each of the first, second, third and fourth pressure chamber columns respectively.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
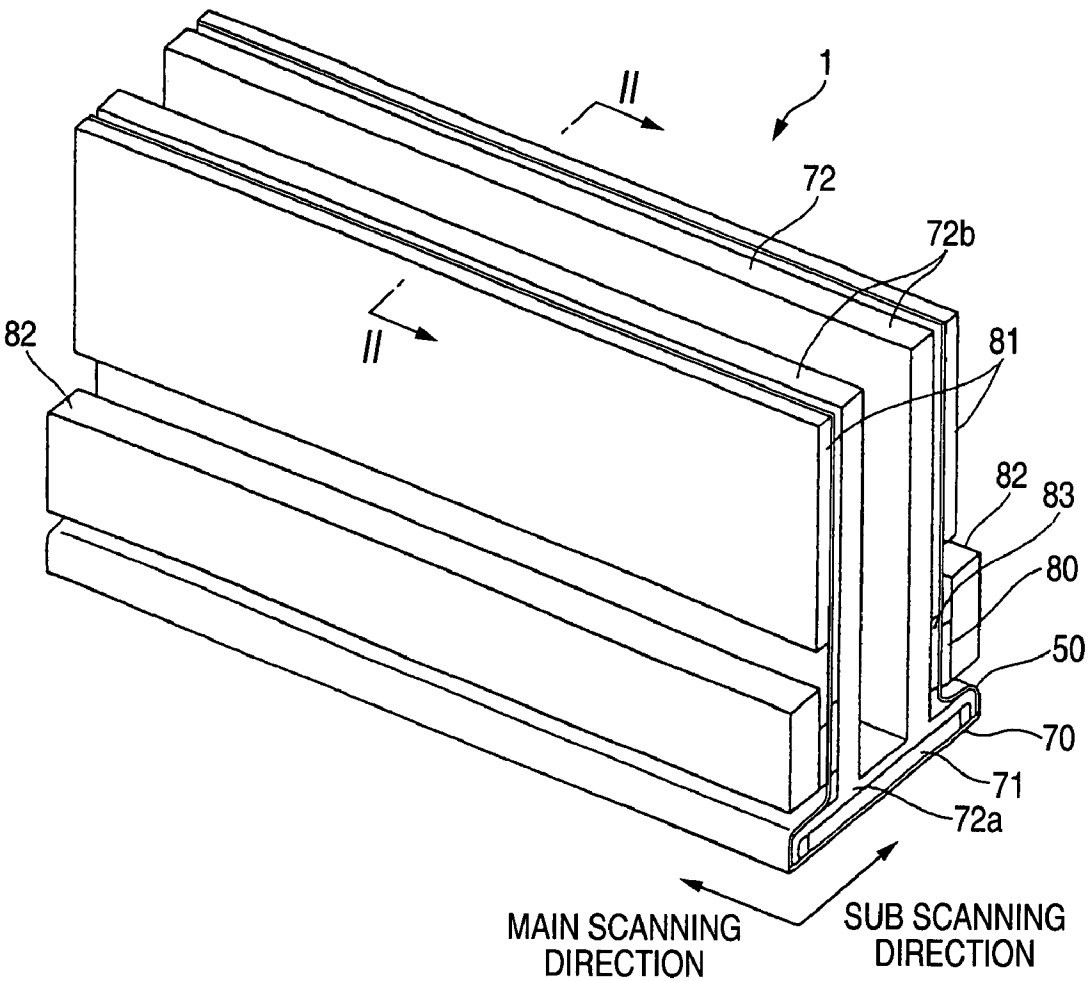
FIG. 1 is a perspective view of an inkjet printing head according to a first embodiment of the invention.
Figure 2:
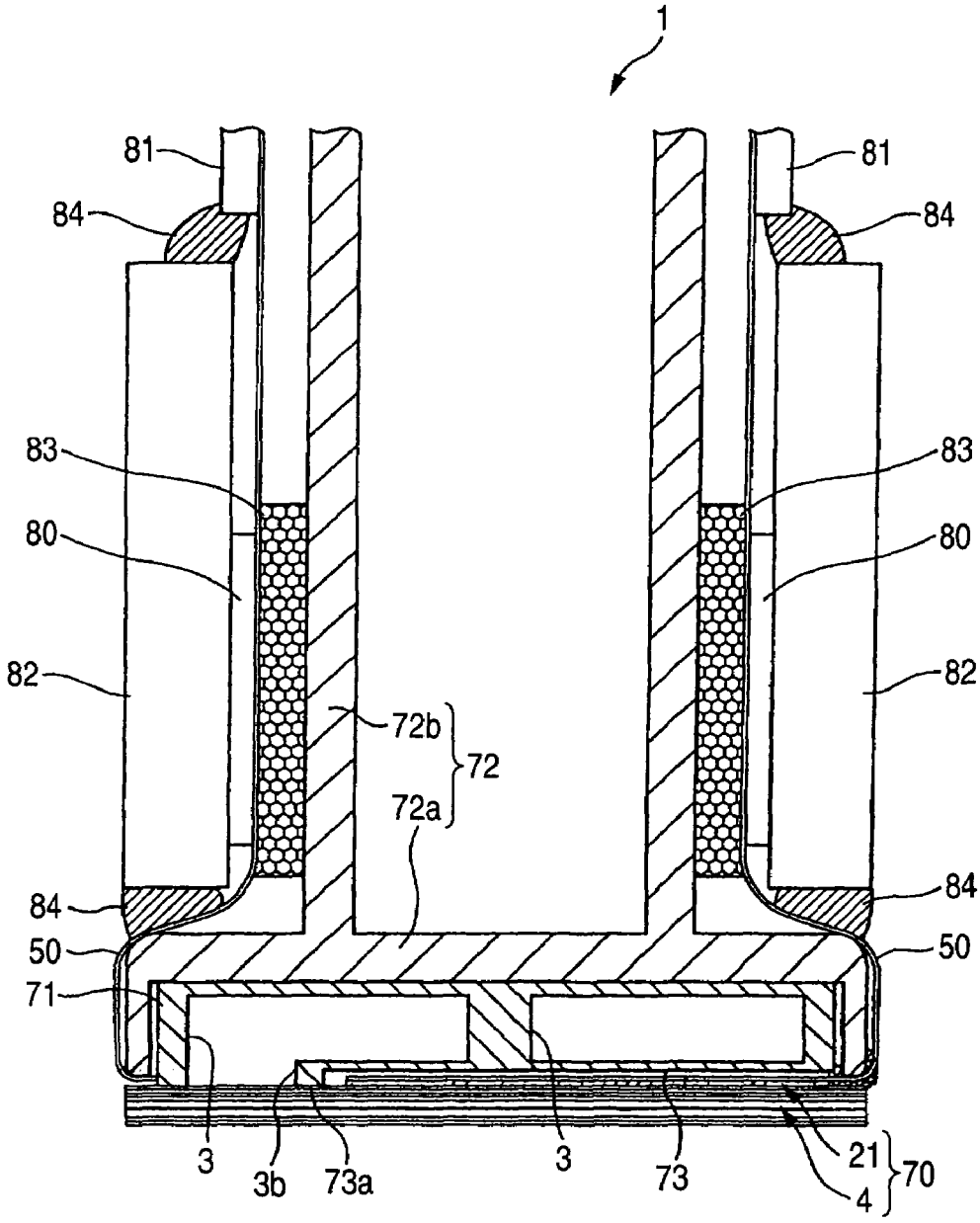
FIG. 2 is a sectional view taken along the line II-II in FIG. 1.

FIG. 1 is a perspective view showing the external appearance of an inkjet printing head according to a first embodiment. FIG. 2 is a sectional view taken along the line II-II in FIG. 1. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70.

The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and bonded to one another. Flexible printed circuit boards (hereinafter referred to as FPCS) 50 which are feeder circuit members are bonded onto an upper surface of the actuator units 21 and pulled out in left and right direction. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 (shown in FIG. 3) only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are bonded to one another by the seal members 84.

Figure 3:
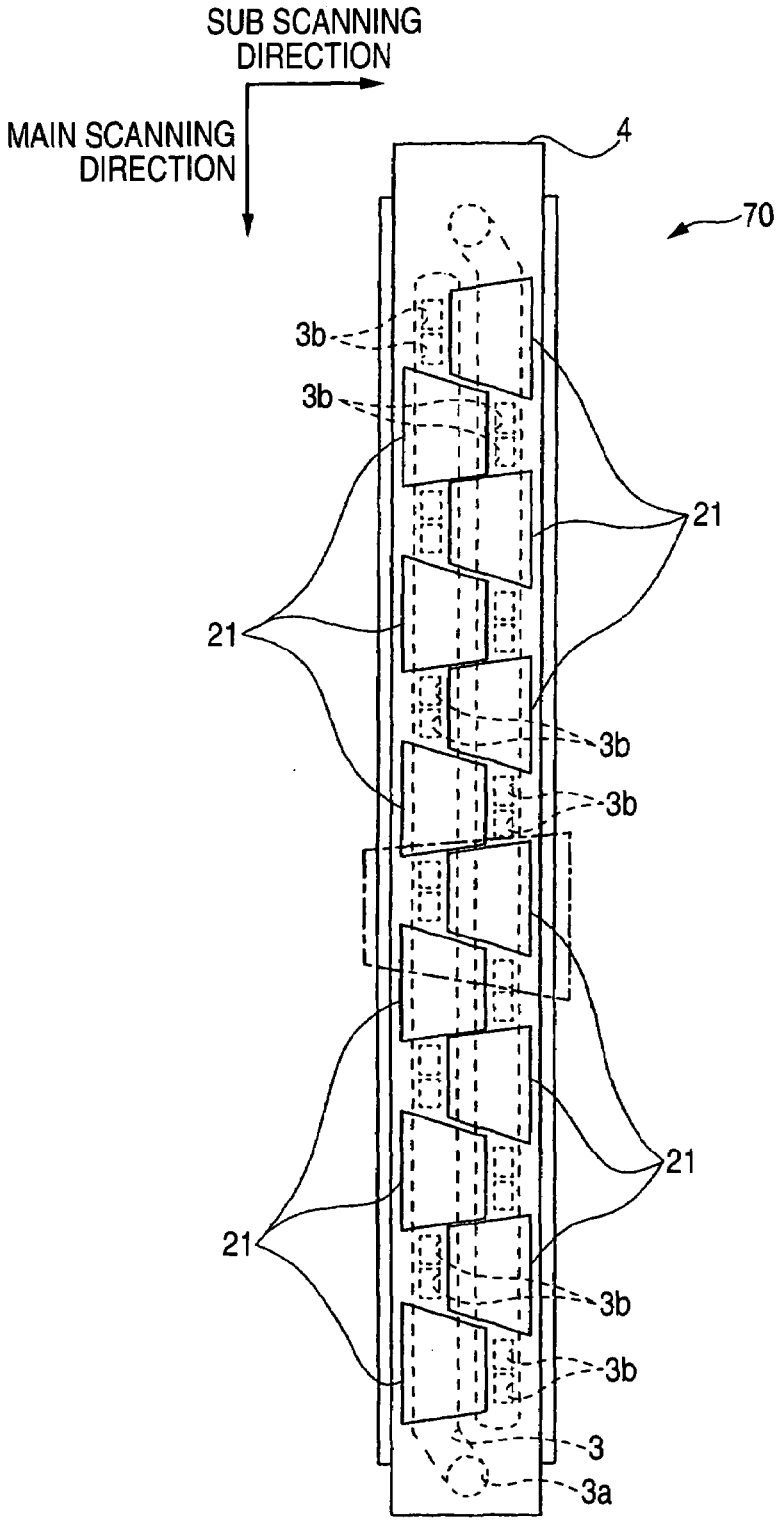
FIG. 3 is a plan view of a head body included in the inkjet printing head depicted in FIG. 2.

FIG. 3 is a plan view of the head body included in the inkjet printing head depicted in FIG. 1. In FIG. 3, the ink reservoirs 3 formed in the base block 71 are drawn virtually by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are arranged in staggered layout.

The plurality of actuator units 21 each having a trapezoid flat shape are disposed in regions where the openings 3*b* are not provided. The plurality of actuator units 21 are arranged in staggered layout so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 4:
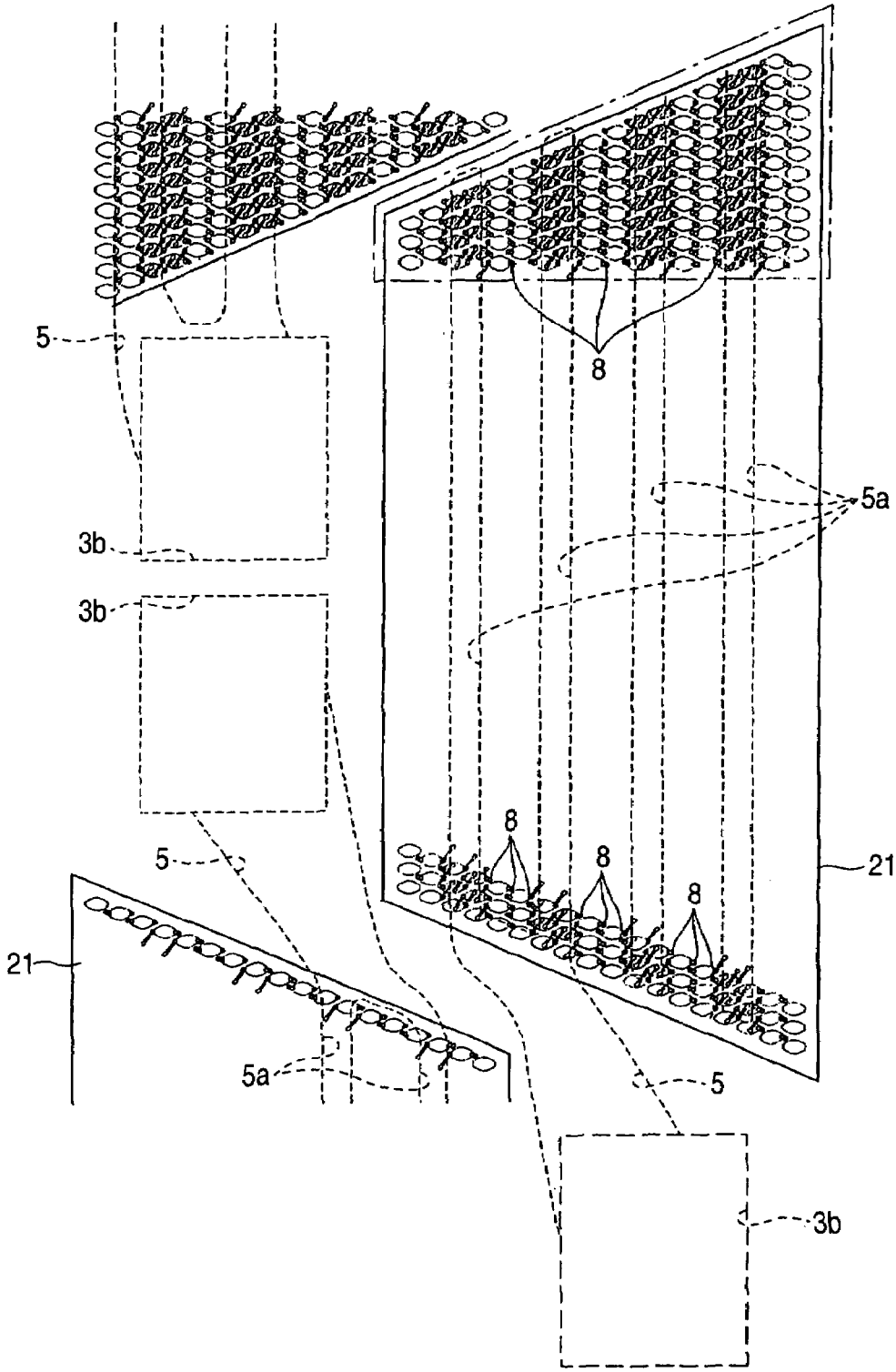
FIG. 4 is an enlarged view of a region surrounded by the chain line in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually arranged on the whole of the ink ejection region.

Figure 5:
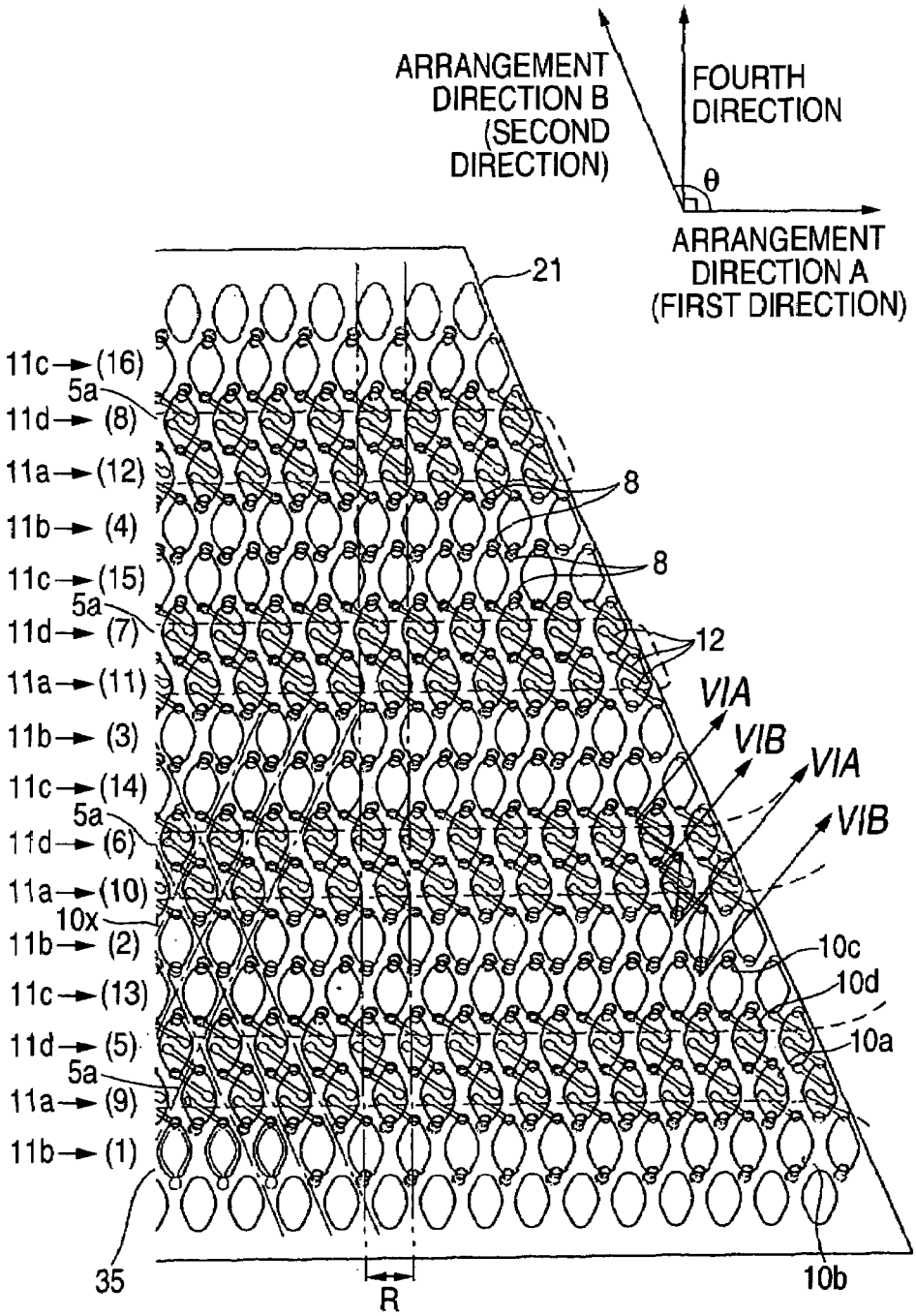
FIG. 5 is an enlarged view of a region surrounded by the chain line in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 has one end connected to a corresponding nozzle 8, and the other end connected to a corresponding sub manifold 5*a* as a common ink flow path through an aperture 12. An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 5 for the sake of simplification. Incidentally, the pressure chambers 10 and apertures 12 that must be expressed by the broken line in the actuator units 21 or in the flow path unit 4 are expressed by the solid line in FIGS. 4 and 5 to make it easy to understand the drawings.

In FIG. 5, a plurality of virtual rhombic regions 10 (10*a*, 10*b*, 10*c* and 10*d*) in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that sixteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*-> . . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6A:
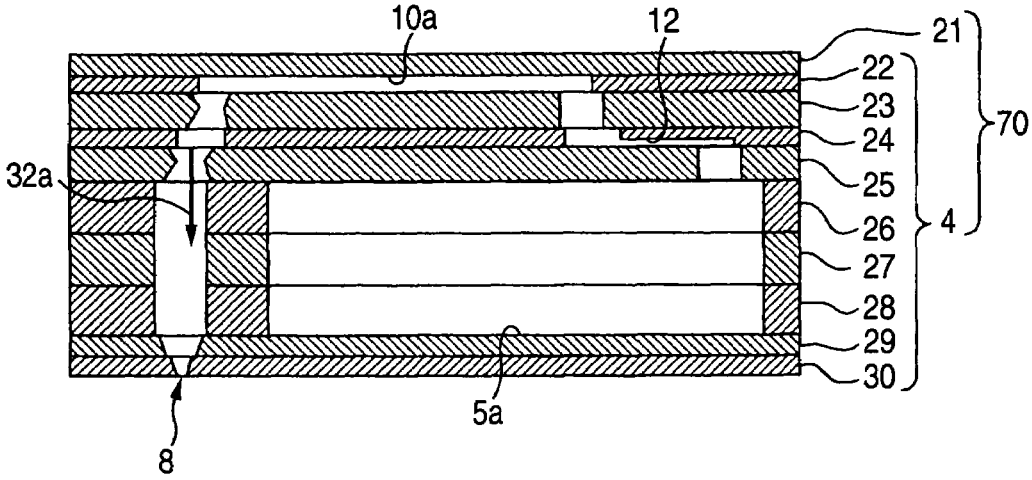
FIG. 6A is a sectional view taken along the like VIA-VIA in FIG. 5.
Figure 6B:
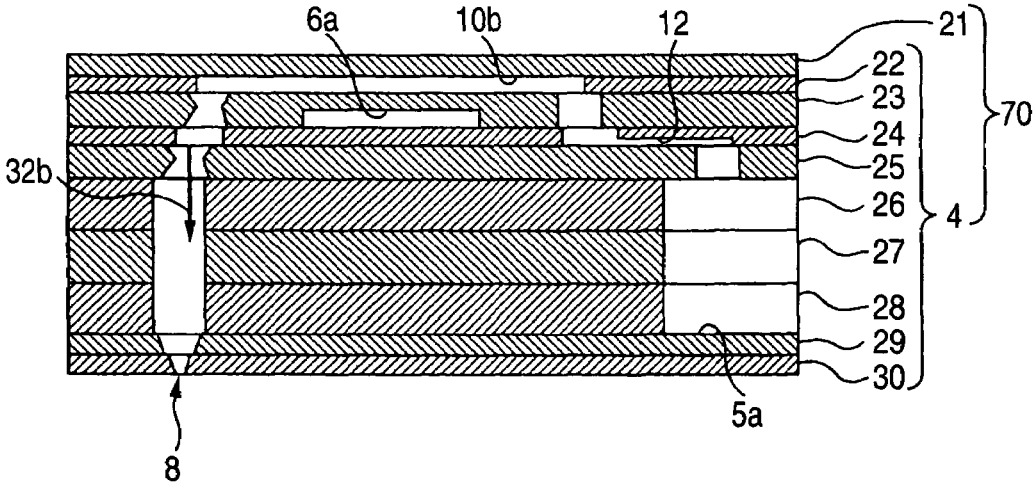
FIG. 6B is a sectional view taken along the like VIB-VIB in FIG. 5.

Next, the sectional structure of the head body 70 will be further described with reference to FIGS. 6A, 6B and 7. FIG. 6A is a sectional view taken along the line VIA-VIA in FIG. 5. FIG. 6A shows a pressure chamber 10*a* belonging to the first pressure chamber column 11*a*. FIG. 6B is a sectional view taken along the line VIB-VIB in FIG. 5. FIG. 6B shows a pressure chamber 10*b* belonging to the second pressure chamber column 11*b*. As is obvious from FIGS. 6A and 6B, each nozzle 8 is connected to a sub manifold 5*a* through the pressure chamber 10 (10*a* or 10*b*) and an aperture 12. In this manner, an individual ink flow path (designated by the reference numeral 32*a* in FIG. 6A or by the reference numeral 32*b* in FIG. 6B) extending from an outlet of the sub manifold 5*a* to the nozzle 8 through the aperture 12 and the pressure chamber 10 is formed in the head body 70 in accordance with the pressure chamber 10.

As is obvious from FIGS. 6A and 6B, the pressure chamber 10 and the aperture 12 are provided in different depths in a direction of lamination of the plurality of thin plates. Accordingly, as shown in FIG. 5, in the flow path unit 4 corresponding to the ink ejection region below the actuator unit 21, an aperture 12 connected to one pressure chamber 10 can be disposed so as to overlap the position of a pressure chamber 10 adjacent to the pressure chamber in plan view. As a result, the pressure chambers 10 adhere to each other so as to be arranged densely. Accordingly, printing of a high-resolution image can be achieved by the inkjet printing head 1 having a relatively small required area.

Figure 7:
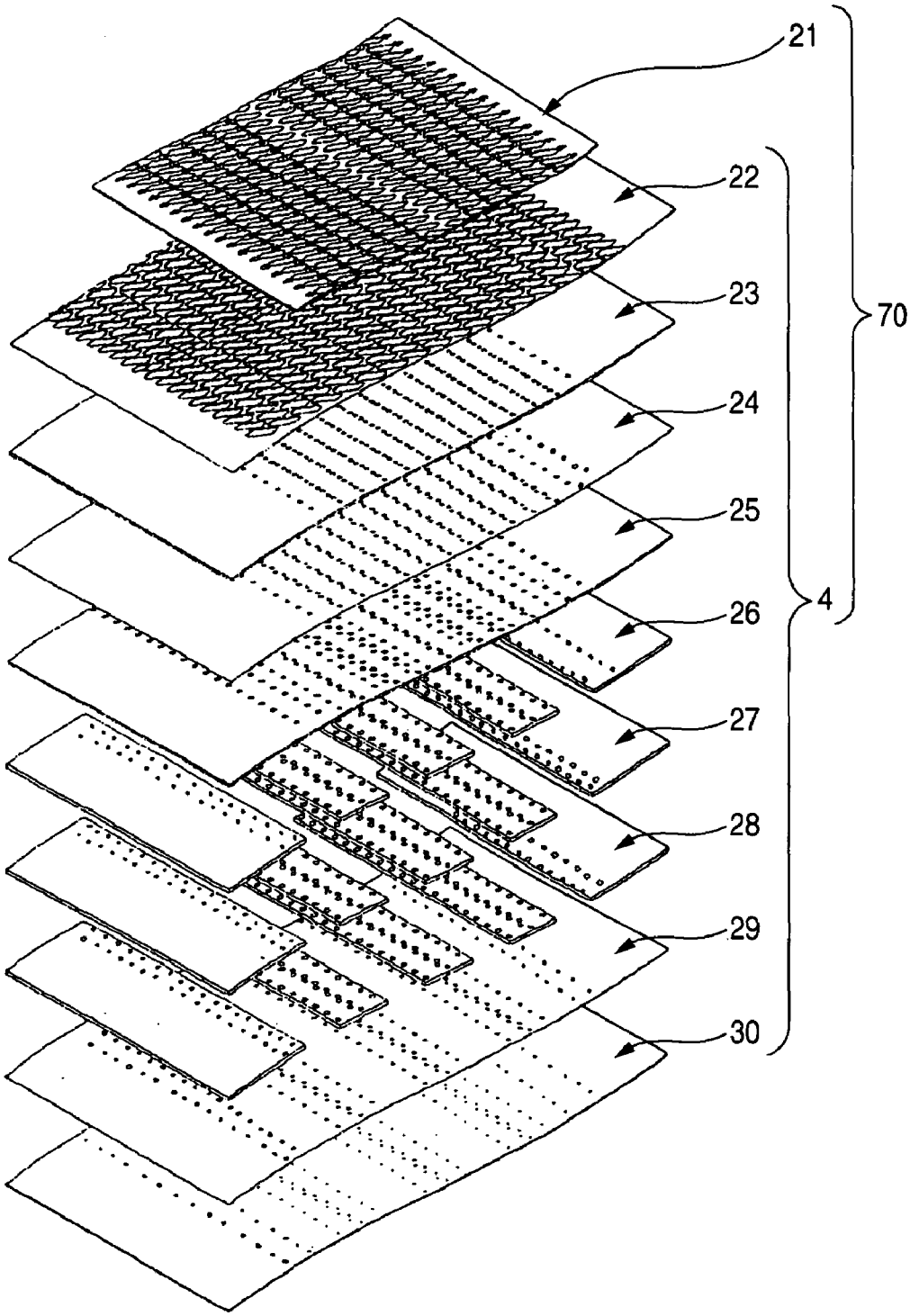
FIG. 7 is a partially exploded perspective view of the head body depicted in FIGS. 6A and 6B.

As is obvious also from FIG. 7, the head body 70 has a laminated structure in which ten sheet materials in total are laminated, that is, an actuator unit 21, a cavity plate 22, a base plate 23, an aperture plate 24, a supply plate 25, manifold plates 26, 27 and 28, a cover plate 29 and a nozzle plate 30 are laminated successively in descending order. The ten sheet materials except the actuator unit 21, that is, nine plates form a flow path unit 4.

As will be described later in detail, the actuator unit 21 includes a laminate of four piezoelectric sheets 41 to 44 (see FIG. 9A) as four layers, and electrodes disposed so that only the uppermost layer is provided as a layer having a portion serving as an active layer at the time of application of electric field (hereinafter referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding nozzle 8. The aperture plate 24 is a metal plate which has apertures 12 (see FIG. 9), and holes 12*d* each for connecting one pressure chamber 10 of the cavity plate 22 to a corresponding nozzle 8. Each of the apertures 12 has an ink inlet 12*a* on the sub manifold 5*a* side, an ink outlet 12*b* on the pressure chamber 10 side, and a communication portion 12*c* formed slimly while connected to the ink inlet and outlet 12*a* and 12*b*. The supply plate 25 is a metal plate which has holes each for connecting an aperture 12 for one pressure chamber 10 of the cavity plate 22 to a corresponding sub manifold 5*a*, and holes each for connecting the pressure chamber 10 to the nozzle 8. The manifold plates 26, 27 and 28 are metal plates which have the sub manifolds 5*a*, and holes each for connecting one pressure chamber 10 of the cavity plate 22 to a corresponding nozzle 8. The cover plate 29 is a metal plate which has holes each for connecting one pressure chamber 10 of the cavity plate 22 to a corresponding nozzle 8. The nozzle plate 30 is a metal plate which has nozzles 8 each provided for one pressure chamber 10 of the cavity plate 22.

The ten sheets 21 to 30 are laminated while positioned so that individual ink flow paths 32 are formed as shown in FIGS. 6A and 6B. Each individual ink flow path 32 first goes upward from the sub manifold 5*a*, extends horizontally in the aperture 12, goes further upward from the aperture 12, extends horizontally again in the pressure chamber 10, momentarily goes obliquely downward in the direction of departing from the aperture 12 and goes vertically downward to the nozzle 8.

As is obvious from FIGS. 6A and 6B, the individual ink flow path 32*a* for the first pressure chamber column 11*a* and the individual ink flow path 32*b* for the second pressure chamber column 11*b* are different from each other in the positional relation between the pressure chamber 10 and the sub manifold 5*a*. Specifically, the pressure chamber 10*a* shown in FIG. 6A is opposite to the sub manifold 5*a* in the direction of lamination of the sheets 21 to 30. On the other hand, the pressure chamber 10*b* shown in FIG. 6B is not opposite to the sub manifold 5*a* in the aforementioned direction. Similarly, as to be understood from FIG. 5 though not shown in sectional view, the individual ink flow path 32*b* for the third pressure chamber column 11*c* and the individual ink flow path 32*a* for the fourth pressure chamber column 11*d* are different from each other in the positional relation between the pressure chamber 10 and the sub manifold 5*a*. The pressure chamber 10*d* is opposite to the sub manifold 5*a* in the aforementioned direction whereas the pressure chamber 10*c* is not opposite to the manifold 5*a* in the aforementioned direction. The positional relation between the pressure chamber 10*a* and the sub manifold 5*a* is the same as the positional relation between the pressure chamber 10*d* and the sub manifold 5*a* except that these positional relations are reversed to each other in the fourth direction. The positional relation between the pressure chamber 10*b* and the sub manifold 5*a* is the same as the positional relation between the pressure chamber 10*c* and the sub manifold 5*a* except that these positional relations are reversed to each other in the fourth direction.

For this reason, if no measures are taken, compliance of the pressure chambers 10*a* and 10*d* under an ink ejection operation becomes larger than compliance of the pressure chambers 10*b* and 10*c*. As a result, a difference in ink ejection speed is generated between nozzles 8 connected to the two types of pressure chambers even in the case where the same drive pulse is given to the two types of pressure chambers. Therefore, in this embodiment, rhombic cavities are formed in portions of the lower surface of the base plate 23 corresponding to the pressure chambers 10*b* and 10*c* by half etching in advance. Accordingly, as shown in FIG. 6B, rhombic spaces 6*a* surrounded by the base plate 23 and the aperture plate 24 are formed below the pressure chambers 10*b* and 10*c* respectively. The rhombic spaces 6*a* are provided on a side opposite to the actuator unit 21 with respect to the pressure chambers 10*b* and 10*c*. The actuator unit 21, the pressure chambers 10*b* and 10*c* and the rhombic spaces 6*a* overlap one another in the direction of lamination of the sheets 21 to 30. On the other hand, there is no rhombic space formed below the pressure chambers 10*a* and 10*b*. Each rhombic space 6*a* is different in material from the metal forming the sheets surrounding the rhombic space 6*a*. The rigidity of each rhombic space 6*a* per se is lower than that of the surroundings. Accordingly, each rhombic space 6*a* has an effect of increasing compliance in the flow path unit 4. That is, the rhombic spaces 6*a* form adjustment portions for adjusting compliance of the pressure chambers 10*b* and 10*c*. As a result, the compliance of the pressure chambers 10*b* and 10*c* is made equal to that of the pressure chambers 10*a* and 10*d*.

Here, in the embodiment, the "compliance" is reciprocal of rigidity, and the phrase "compliance of a pressure chamber" is used in a meaning "ease of deformation (change in volume) of the pressure chamber". The compliance of a pressure chamber is determined depending on the structure surrounding the pressure chamber, and is dominated by the laminated structure above and below of the pressure chamber in the embodiment.

Figure 8:
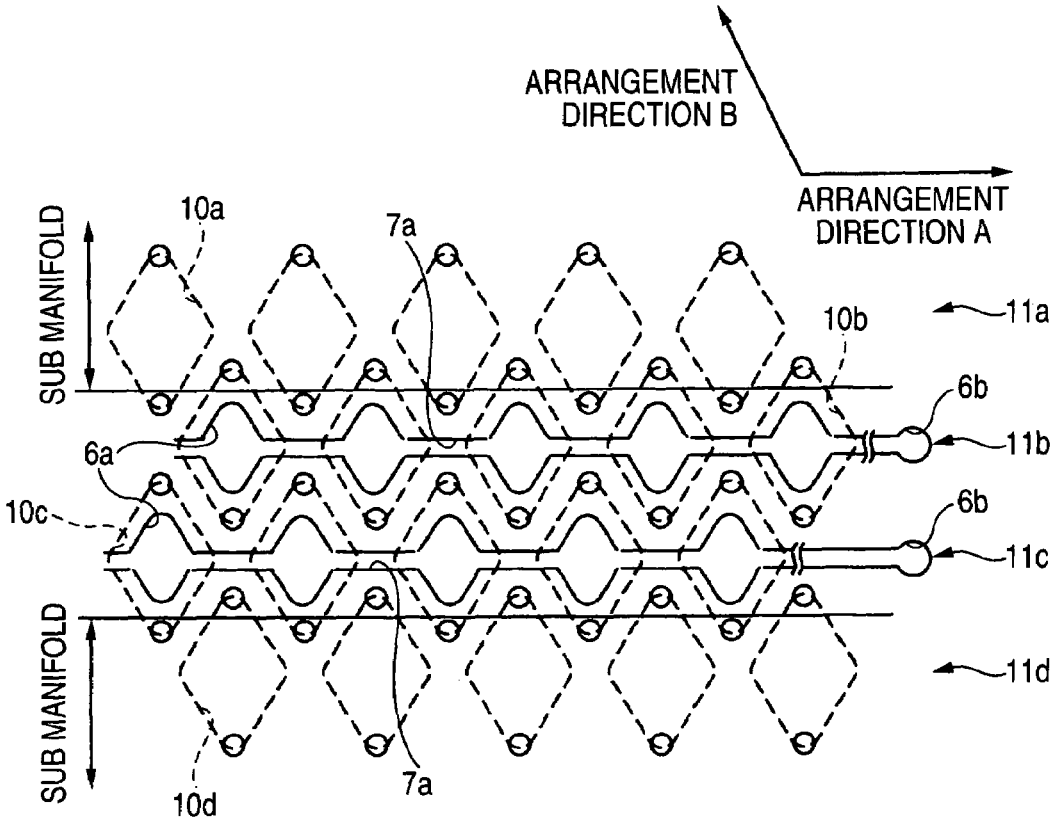
FIG. 8 is a plan view of a base plate depicted in FIGS. 6A and 6B.
Figure 11:
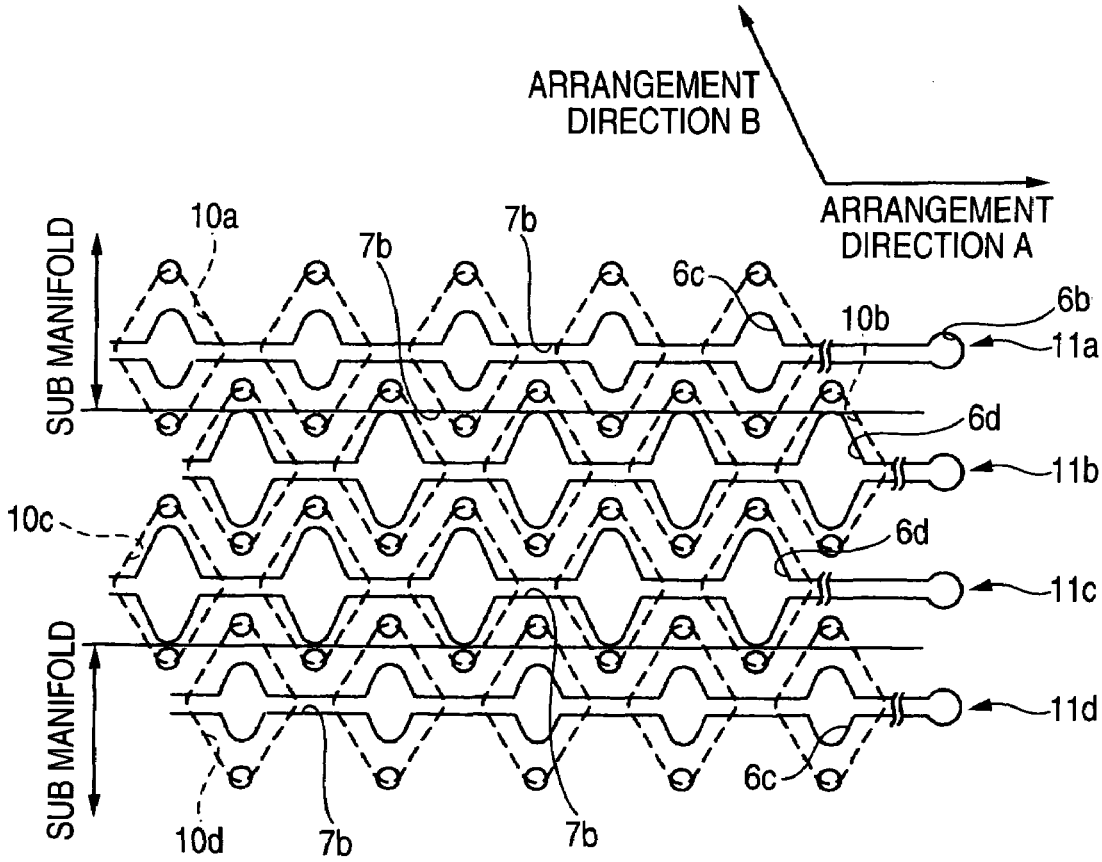
FIG. 11 is a plan view of the base plate depicted in FIGS. 10A and 10B.

FIG. 8 is a plan view of the base plate 23 from the aperture plate 24 side. As shown in FIG. 8, in this embodiment, the rhombic spaces 6*a* are similar in shape to the pressure chambers 10*b* and 10*c* but smaller by a size than the pressure chambers 10*b* and 10*c*. For this reason, compliance can be adjusted easily. The rhombic spaces 6*a* disposed below pressure chambers 10*b* and 10*c* respectively are connected to the rhombic spaces 6*a* disposed below pressure chambers 10*b* and 10*c* adjacent to the pressure chambers 10*b* and 10*c* in the respective pressure chamber columns 11*b* and 11*c*, by slender groove-like spaces 7*a* respectively. That is, the rhombic spaces 6*a* corresponding to the pressure chamber columns 11*b* and 11*c* form space columns respectively. In each of the space columns, the rhombic spaces 6*a* are connected to one another. The rhombic spaces 6*a* connected to one another in each space column communicate with the air through a hole 6*b* connected to the outside of the flow path unit 4 at an end of the space column. Incidentally, the sentence "the rhombic spaces 6*a* are similar in shape to the pressure chambers 10*b* and 10*c*" used in the invention is not limited to the case where the rhombic spaces 6*a* are different in size from the pressure chambers 10 but similar in shape to the pressure chambers 10, that is, the meaning of the sentence includes the case where the rhombic spaces 6*a* resemble the pressure chambers 10*b* and 10*c* in shape, for example, as shown in FIG. 11.

Figure 9A:
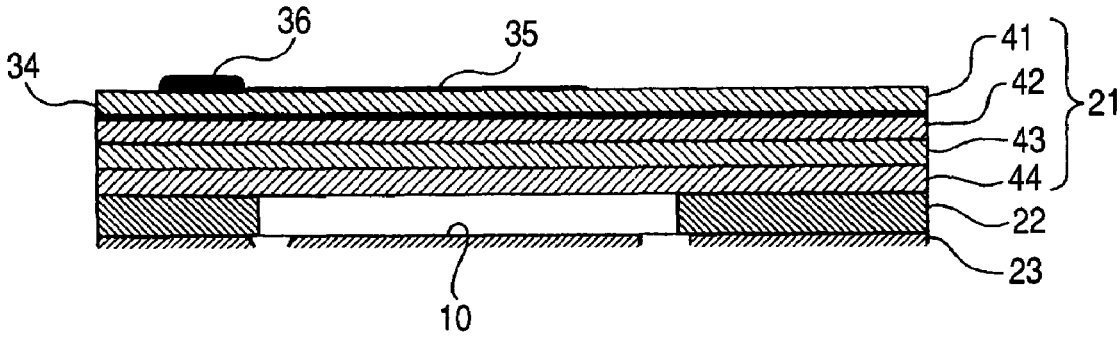
FIGS. 9A and 9B are partially enlarged views of an actuator unit depicted in FIGS. 6A and 6B.
Figure 9B:
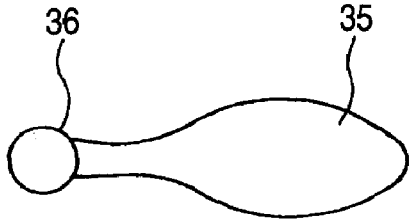

Next, the configuration of the actuator unit 21 laminated on the cavity plate 22 as the uppermost layer of the flow path unit 4 will be described. FIG. 9A is a partially enlarged sectional view showing the actuator unit 21 and a pressure chamber 10. FIG. 9B is a plan view showing the shape of an individual electrode bonded to a surface of the actuator unit 21.

As shown in FIG. 9A, the actuator unit 21 includes four piezoelectric sheets 41, 42, 43 and 44 formed to have a thickness of about 15 μm equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2 μm is interposed between the piezoelectric sheet 41 as the uppermost layer and the piezoelectric sheet 42 located under the piezoelectric sheet 41 so that the common electrode 34 is formed on the whole surface of the piezoelectric sheet 42. The individual electrodes 35 and the common electrode 34 are made of a metal material such as Ag—Pd.

As shown in FIG. 9B, each individual electrode 35 has a thickness of about 1 μm and substantially has a rhomboid shape nearly similar to the shape of the pressure camber 10 shown in FIG. 5. An acute-angled portion of each approximately rhomboid individual electrode 35 extends. A circular land portion 36 having a diameter of about 160 μm is provided at an end of the extension of the acute-angled portion of the individual electrode 35 so as to be electrically connected to the individual electrode 35. For example, the land portion 36 is made of gold containing glass frit. As shown in FIG. 9A, the land portion 36 is bonded onto a surface of the extension of the individual electrode 35.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Figure 10A:
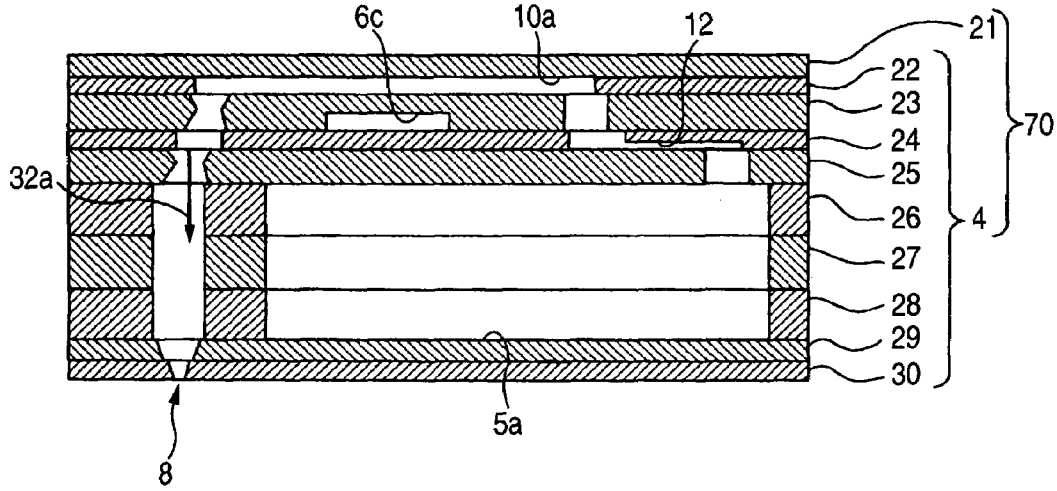
FIGS. 10A and 10B are sectional views showing a head body of an inkjet printing head according to a second embodiment of the invention.

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 10A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

Incidentally, another drive method may be used as follows. The electric potential of each individual electrode 35 is set at a value different from the electric potential of the common electrode 34 in advance. Whenever there is an ejection request, the electric potential of the individual electrode 35 is once changed to the same value as the electric potential of the common electrode 34. Then, the electric potential of the individual electrode 35 is returned to the original value different from the electric potential of the common electrode 34 at predetermined timing. In this case, the piezoelectric sheets 41 to 44 are restored to the original shape at the timing when the electric potential of the individual electrode 35 becomes equal to the electric potential of the common electrode 34. Accordingly, the volume of the pressure chamber 10 is increased compared with the initial state (in which the two electrodes are different in electric potential from each other), so that ink is sucked from the manifold 5 side into the pressure chamber 10. Then, the piezoelectric sheets 41 to 44 are deformed so as to be curved convexly on the pressure chamber 10 side at the timing when the electric potential of the individual electrode 35 is set at the original value different from the electric potential of the common electrode 34 again. As a result, the volume of the pressure chamber 10 is reduced to increase the pressure of ink to thereby eject ink.

Referring back to FIG. 5, a zonal region R having a width (678.0 μm) corresponding to 37.5 dpi in the arrangement direction A and extending in the arrangement direction B will be considered. Only one nozzle 8 is present in any one of sixteen pressure chamber columns 11*a* to 11*d* in the zonal region R. That is, when such a zonal region R is formed in an optional position of the ink ejection region corresponding to one actuator unit 21, sixteen nozzles 8 are always distributed in the zonal region R. The positions of points obtained by projecting the sixteen nozzles 8 onto a line extending in the arrangement direction A are arranged at intervals of a distance corresponding to 600 dpi which is resolution at the time of printing.

When the sixteen nozzles 8 belonging to one zonal region R are numbered as (1) to (16) in rightward order of the positions of points obtained by projecting the sixteen nozzles 8 onto a line extending in the arrangement direction A, the sixteen nozzles 8 are arranged in ascending order of (1), (9), (5), (13), (2), (10), (6), (14), (3), (11), (7), (15), (4), (12), (8) and (16). When the inkjet printing head 1 configured as described above is driven suitably in accordance with conveyance of a printing medium in the actuator unit 21, characters, graphics, etc. having resolution of 600 dpi can be drawn.

For example, description will be made on the case where a line extending in the arrangement direction A is printed with resolution of 600 dpi. First, brief description will be made on the case of a reference example in which each nozzle 8 is connected to the acute-angled portion on the same side of the pressure chamber 10. In this case, a nozzle 8 in the pressure chamber column located in the lowermost position in FIG. 5 begins to eject ink in accordance with conveyance of the printing medium. Nozzles 8 belonging to adjacent pressure chamber columns on the upper side are selected successively to eject ink. Accordingly, dots of ink are formed so as to be adjacent to one another at intervals of a distance corresponding to 600 dpi in the arrangement direction A. Finally, a line extending in the arrangement direction A is drawn with resolution of 600 dpi as a whole.

On the other hand, in this embodiment, a nozzle 8 in the pressure chamber column 11*b* located in the lowermost position in FIG. 5 begins to eject ink. As the printing medium is conveyed, nozzles 8 connected to adjacent pressure chambers on the upper side are selected successively to eject ink. On this occasion, the displacement of the nozzle 8 position in the arrangement direction A in accordance with increase in position by one pressure chamber column from the lower side to the upper side is not constant. Accordingly, dots of ink formed successively along the arrangement direction A in accordance with conveyance of the printing medium are not arranged at regular intervals of 600 dpi.

That is, as shown in FIG. 5, ink is first ejected from the nozzle (1) connected to the pressure chamber column 11*b* located in the lowermost position in FIG. 5 in accordance with conveyance of the printing medium. A row of dots are formed on the printing medium at intervals of a distance corresponding to 37.5 dpi. Then, when the line forming position reaches the position of the nozzle (9) connected to the second lowest pressure chamber column 11*a* as the printing medium is conveyed, ink is ejected from the nozzle (9). As a result, a second ink dot is formed in a position displaced by eight times as large as the distance corresponding to 600 dpi in the arrangement direction A from the initial dot position.

Then, when the line forming position reaches the position of the nozzle (5) connected to the third lowest pressure chamber column 11*d* as the printing medium is conveyed, ink is ejected from the nozzle (5). As a result, a third ink dot is formed in a position displaced by four times as large as the distance corresponding to 600 dpi in the arrangement direction A from the initial dot position. When the line forming position reaches the position of the nozzle (13) connected to the fourth lowest pressure chamber column 11*c* as the printing medium is further conveyed, ink is ejected from the nozzle (13). As a result, a fourth ink dot is formed in a position displaced by twelve times as large as the distance corresponding to 600 dpi in the arrangement direction A from the initial dot position. When the line forming position reaches the position of the nozzle (2) connected to the fifth lowest pressure chamber column 11*b* as the printing medium is further conveyed, ink is ejected from the nozzle (2). As a result, a fifth ink dot is formed in a position displaced by the distance corresponding to 600 dpi in the arrangement direction A from the initial dot position.

Then, ink dots are formed in the same manner as described above while nozzles 8 connected to the pressure chambers 10 are selected successively from the lower side to the upper side in FIG. 5. When N is the number of a nozzle 8 shown in FIG. 5 on this occasion, an ink dot is formed in a position displaced by a value corresponding to (the ratio n=N−1)×(the distance corresponding to 600 dpi) in the arrangement direction A from the initial dot position. Finally, when selection of the sixteen nozzles 8 is completed, fifteen dots formed at intervals of a distance corresponding to 600 dpi are interpolated in between ink dots formed at intervals of a distance corresponding to 37.5 dpi by the nozzle (1) in the lowest pressure chamber column 11*b* in FIG. 5. As a result, a line extending in the arrangement direction A can be drawn with resolution of 600 dpi as a whole.

Incidentally, printing with resolution of 600 dpi can be achieved when neighbors of opposite end portions of each ink ejection region (inclined sides of each actuator unit 21) in the arrangement direction A are complementary to neighbors of opposite end portions of corresponding ink ejection regions in the arrangement direction A to other actuator unit 21 opposed to the actuator unit 21 in the direction of the width of the head body 70.

As described above, in this embodiment, because the rhombic spaces 6*a* are provided along the pressure chamber columns 11*b* and 11*c*, pressure chambers 10 belonging to any one of the pressure chamber columns 11*a* to 11*d* are equal in compliance to one another when the actuator unit 21 is driven. Accordingly, the speed of ink ejected from the nozzles 8 can be made uniform sufficiently to improve the quality of a print image. Moreover, because the rhombic spaces 6*a* are provided so as to correspond to only the pressure chamber columns 11*b* and 11*c*, that is, because the rhombic spaces 6*a* are provided so as not to correspond to the pressure chamber columns 11*a* and 11*d*, the number of the rhombic spaces 6*a* can be reduced to a relatively small value to simplify the structure. Moreover, because the rhombic spaces 6*a* are similar in shape to the pressure chambers 10, compliance can be adjusted relatively easily without necessity of reducing the total rigidity of the flow path unit to a lower value than required. Moreover, because the rhombic spaces 6*a* are opposite to the pressure chambers 10 and formed in positions relatively near to the pressure chambers 10 respectively, compliance can be adjusted efficiently while the size of each rhombic space 6*a* is minimized.

Moreover, because the air in the rhombic spaces 6*a* is used as a compliance adjusting substance, it is unnecessary to receive another substance in the rhombic spaces 6*a*. Accordingly, production can be made easily. Moreover, because the rhombic spaces 6*a* are connected to the atmospheric air, the air in the rhombic spaces 6*a* flows out to the outside when the rhombic spaces 6*a* are compressed by vibration generated in the pressure chambers 10. Accordingly, the possibility that the rhombic spaces 6*a* may be broken by excessive air pressure can be reduced. In addition, ink leakage caused by breaking of the rhombic spaces 6*a* can be avoided. Moreover, because the rhombic spaces 6*a* corresponding to each pressure chamber column are connected to one another, it is unnecessary to connect the rhombic spaces 6*a* one by one to the atmospheric air. Accordingly, the structure can be simplified. Moreover, because the rhombic spaces 6*a* are connected to one another by the groove-like spaces 7*a*, compliance can be adjusted easily without great reduction in the similarity of the rhombic spaces 6*a* to the pressure chambers 10. Moreover, because the rhombic spaces 6*a* have a compliance increasing effect on the basis of the difference in physical property between the air and the material for forming the plates 22 to 30 forming the flow path unit 4, compliance of the pressure chambers 10 not opposite to the sub manifolds 5*a* can be adjusted easily while compliance of the pressure chambers 10 opposite to the sub manifolds 5*a* is large.

Next, a second embodiment of the invention will be described. The inkjet printing head according to this embodiment is different from that according to the first embodiment in only the structure concerning the spaces provided for adjusting compliance. That is, the inkjet printing head according to this embodiment is the same as that according to the first embodiment with respect to the structure shown in FIGS. 1 to 5, FIG. 7 and FIGS. 9A and 9B but the inkjet printing head according to this embodiment is different from that according to the first embodiment with respect to the structure shown in FIGS. 6A and 6B and FIG. 8. Therefore, description will be made mainly on the point of difference while members the same as those in the first embodiment are denoted by the same reference numerals as those in the first embodiment for the sake of omission of duplicated description.

Figure 10B:
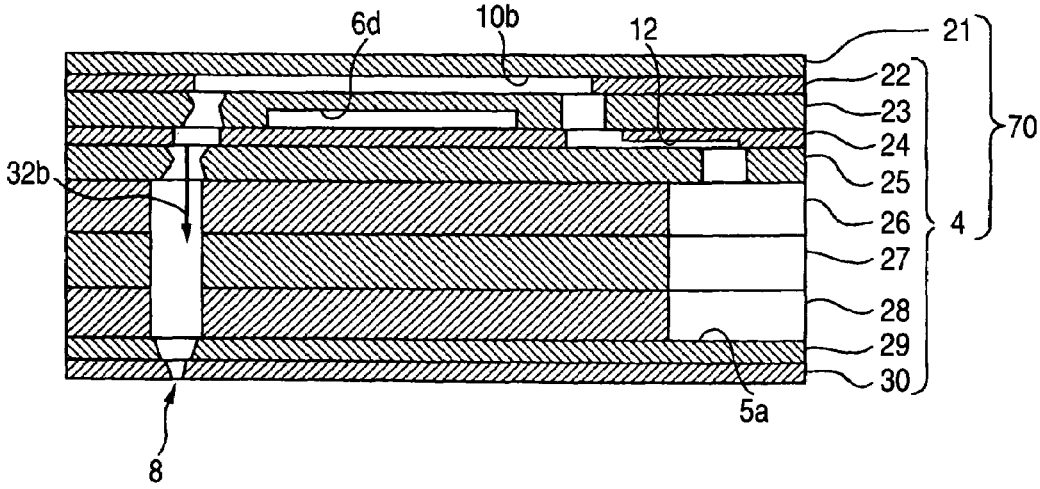

FIGS. 10A and 10B are sectional views showing the inkjet printing head according to this embodiment. FIGS. 10A and 10B correspond to FIGS. 6A and 6B concerning the first embodiment. FIG. 11 is a plan view showing the inkjet printing head according to this embodiment. FIG. 11 corresponds to FIG. 8 concerning the first embodiment. As is obvious from FIGS. 10A and 10B and FIG. 11, in this embodiment, cavities are formed in the base plate 23 so that rhombic spaces 6*c* are formed below the pressure chambers 10*a* and 10*d* while rhombic spaces 6*d* are formed below the pressure chambers 10*b* and 10*c*. The rhombic spaces 6*c* have the same height as that of the rhombic spaces 6*d*. As shown in FIG. 11, both the rhombic spaces 6*c* and 6*d* are similar in shape to the pressure chambers 10 but smaller by a size than the pressure chambers 10. The rhombic spaces 6*d* larger than the rhombic spaces 6*c* have a compliance increasing effect higher than that of the rhombic spaces 6*c*. As a result, compliance of the pressure chambers 10*b* and 10*c* can be made equal to compliance of the pressure chambers 10*a* and 10*d*.

As shown in FIG. 11, the rhombic spaces 6*c* and 6*d* disposed below pressure chambers 10*a* to 10*d* are connected to the rhombic spaces 6*c* and 6*d* disposed below adjacent pressure chambers 10*a* to 10*d* in the pressure chamber columns 11*a* to 11*d*, by slender groove-like spaces 7*b* respectively. That is, the rhombic spaces 6*c* and 6*d* corresponding to the pressure chamber columns 11*a* to 11*d* respectively form space columns respectively. In each space column, the rhombic spaces are connected to one another. The rhombic spaces 6*c* or 6*d* connected to one another in each space column communicate with the atmospheric air through a hole 6*b* connected to the outside of the flow path unit 4 at an end of the space column.

In this embodiment, the rhombic spaces 6*c* and 6*d* are provided in all the pressure chamber columns 11*a* to 11*d* while the rhombic spaces 6*d* are made larger than the rhombic spaces 6*c* in plan view. Accordingly, compliance of pressure chambers 10 belonging to any one of the pressure chamber columns 11*a* to 11*d* is equalized when the actuator unit 21 is driven. Accordingly, the speed of ink ejected from the nozzles 8 can be made uniform sufficiently to improve the quality of a print image. In addition, when the inkjet printing head according to this embodiment is used, the same benefit as in the first embodiment can be obtained.

Next, a third embodiment of the invention will be described. The inkjet printing head according to this embodiment is different from that according to the first embodiment in only the structure concerning the spaces provided for adjusting compliance. That is, the inkjet printing head according to this embodiment is the same as that according to the first embodiment with respect to the structure shown in FIGS. 1 to 5, FIG. 7 and FIGS. 9A and 9B but the inkjet printing head according to this embodiment is different from that according to the first embodiment with respect to the structure shown in FIGS. 6A and 6B and FIG. 8. Therefore, description will be made mainly on the point of difference while members the same as those in the first embodiment are denoted by the same reference numerals as those in the first embodiment for the sake of omission of duplicated description.

Figure 12A:
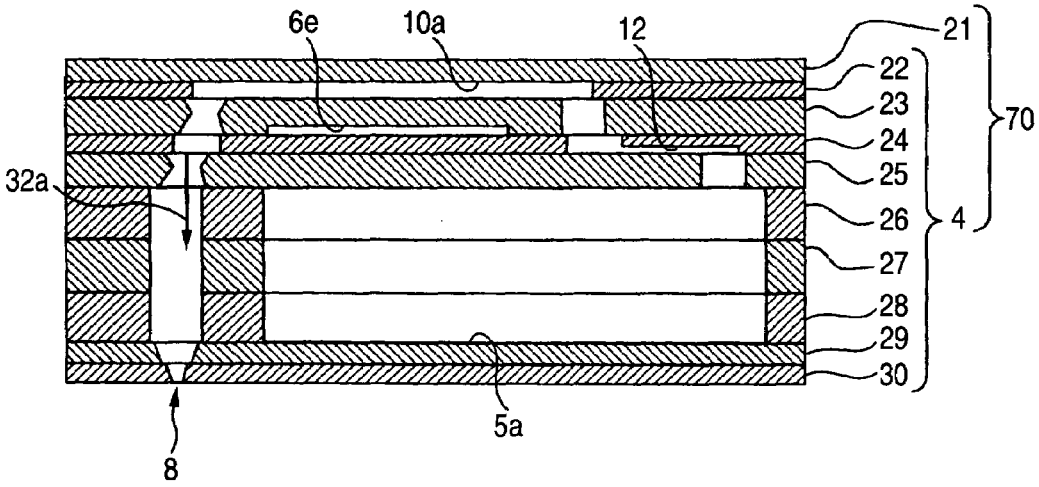
FIGS. 12A and 12B are sectional view showing a head body of an inkjet printing head according to a third embodiment.
Figure 12B:
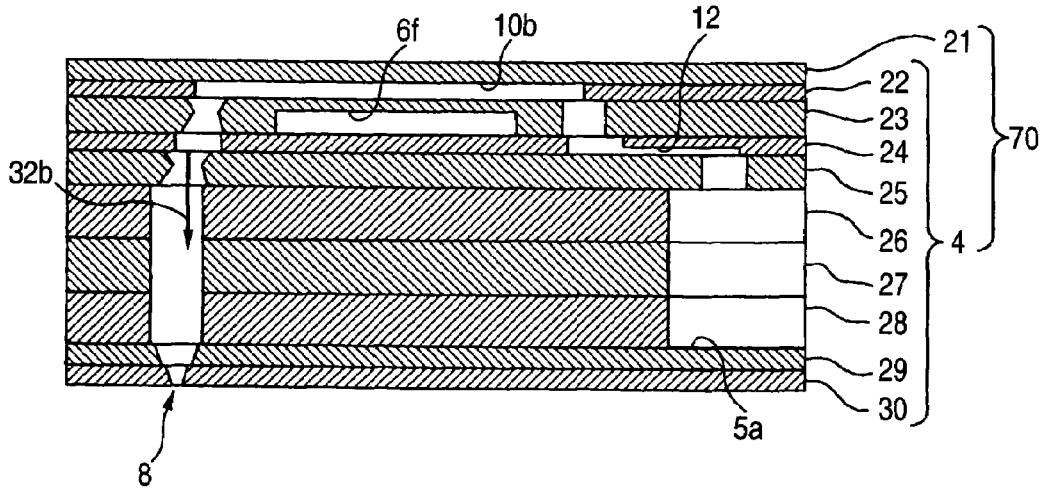
Figure 13:
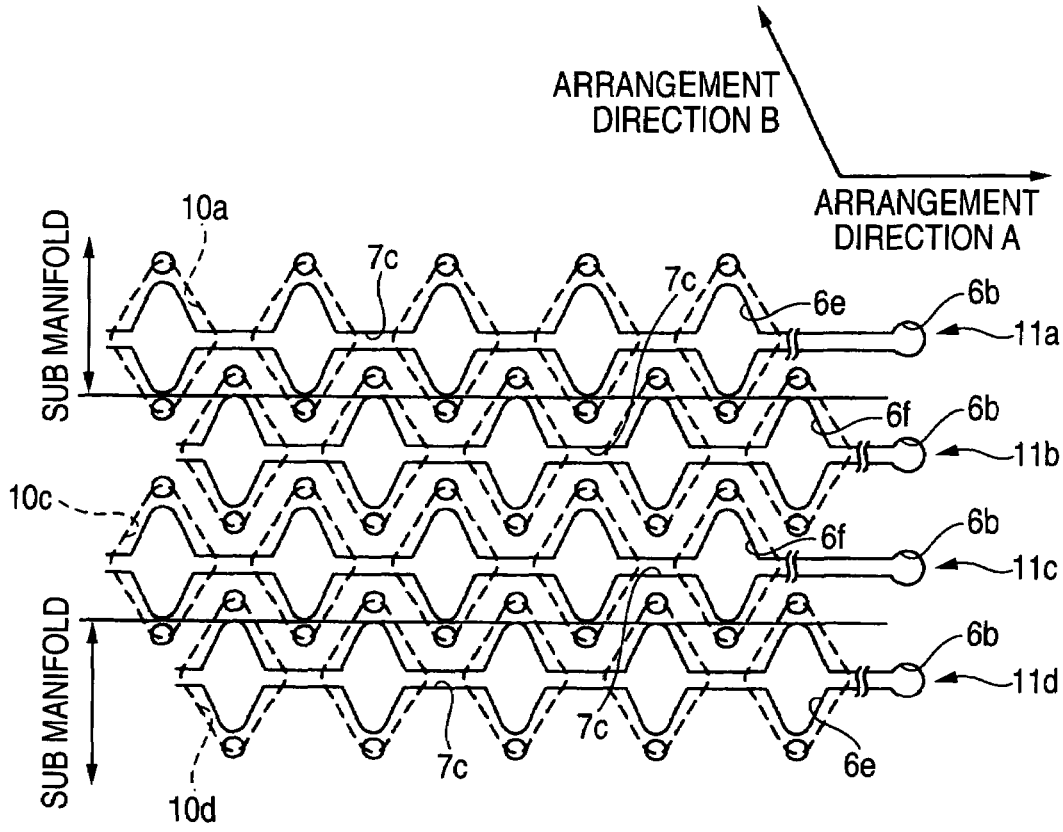
FIG. 13 is a plan view of the base plate depicted in FIGS. 12A and 12B.

FIGS. 12A and 12B are sectional views showing the inkjet printing head according to this embodiment. FIGS. 12A and 12B correspond to FIGS. 6A and 6B concerning the first embodiment. FIG. 13 is a plan view showing the inkjet printing head according to this embodiment. FIG. 13 corresponds to FIG. 8 concerning the first embodiment. As is obvious from FIGS. 12A and 12B and FIG. 13, in this embodiment, cavities are formed in the base plate 23 so that rhombic spaces 6*e* are formed below the pressure chambers 10*a* and 10*d* while rhombic spaces 6*f* are formed below the pressure chambers 10*b* and 10*c*. The height of the rhombic spaces 6*f* is about 1.5 times as large as the height of the rhombic spaces 6*e*. As shown in FIG. 13, both the rhombic spaces 6*e* and 6*f* are similar in shape to the pressure chambers 10 but smaller by a size than the pressure chambers 10. In addition, the rhombic spaces 6*e* and 6*f* are the same in planar shape. The rhombic spaces 6*f* higher than the rhombic spaces 6*e* have a compliance increasing effect higher than that of the rhombic spaces 6*e*. As a result, compliance of the pressure chambers 10*b* and 10*c* can be made equal to compliance of the pressure chambers 10*a* and 10*d*.

As shown in FIG. 13, the rhombic spaces 6*e* and 6*f* disposed below pressure chambers 10*a* to 10*d* are connected to the rhombic spaces 6*e* and 6*f* disposed below adjacent pressure chambers 10*a* to 10*d* in the pressure chamber columns 11*a* to 11*d*, by slender groove-like spaces 7*c* respectively. That is, the rhombic spaces 6*e* and 6*f* corresponding to the pressure chamber columns 11*a* to 11*d* respectively form space columns respectively. In each space column, the rhombic spaces are connected to one another.

The rhombic spaces 6*e* or 6*f* connected to one another in each space column communicate with the atmospheric air through a hole 6*b* connected to the outside of the flow path unit 4 at an end of the space column.

In this embodiment, the rhombic spaces 6*e* and 6*f* are provided in all the pressure chamber columns 11*a* to 11*d* while the height of the rhombic spaces 6*f* is made higher than the height of the rhombic spaces 6*e*. Accordingly, compliance of pressure chambers 10 belonging to any one of the pressure chamber columns 11*a* to 11*d* is equalized when the actuator unit 21 is driven. Accordingly, the speed of ink ejected from the nozzles 8 can be made uniform sufficiently to improve the quality of a print image. In addition, when the inkjet printing head according to this embodiment is used, the same benefit as in the first embodiment can be obtained.

Although preferred embodiments of the invention have been described above, the invention is not limited to the embodiments and various changes on design may be made without departing from the scope of claim. For example, the spaces may be shaped so as not to be similar to the pressure chambers. The spaces may be formed by the provision of cavities in another plate than the base plate or may be formed over two or more plates. The spaces may be formed so that a plurality of spaces are separated in up/down and left/right directions.

The spaces may have the compliance adjusting effect even in the case where the spaces are provided in positions not opposite to the pressure chambers. In this case, the spaces may be formed in positions not opposite to the pressure chambers. The spaces need not communicate with the atmospheric air. Adjacent spaces need not be connected to each other.

Although the embodiments have been described on the case where the spaces are provided as adjustment portions, the adjustment portions may be made of a material different in compliance adjusting effect from each plate material forming the flow path unit. For example, the spaces may be filled with a metal, a liquid, a resin or the like so as to be provided as the adjustment portions.

Although the embodiments have been described on the case where compliance of pressure chambers 10 belonging to any one of the pressure chamber columns 11*a* to 11*d* is equalized, the invention is not limited to the case. The invention can be modified if the difference in compliance between pressure chambers can be reduced to an acceptable degree in practical use by the provision of the rhombic spaces 6*a* to 6*f* in comparison with the case where the rhombic spaces are not provided at all.

The arrangement of the pressure chambers and the common ink chamber is not limited to the embodiments. Various changes on design may be made.

As described above, the inkjet printing head according to the embodiment includes: a flow path unit including a common ink chamber, and a plurality of individual ink flow paths for leading ink from an outlet of the common ink chamber to nozzles through pressure chambers respectively, the plurality of pressure chambers being arranged in the form of material along a plane so that the plurality of individual ink flow paths are different in positional relation between the common ink chamber and the pressure chambers; and an actuator unit fixed to a surface of the flow path unit for changing the volume of each of the pressure chambers. Adjustment portions having an effect of adjusting compliance of the pressure chambers are provided in the flow path unit at a side opposite to the actuator unit with respect to the pressure chambers so that compliance of the plurality of pressure chambers corresponding to the plurality of individual ink flow paths different in the positional relation is equalized.

In another aspect, the inkjet printing head according to the embodiment includes: a flow path unit including a common ink chamber, and a plurality of individual ink flow paths for leading ink from an outlet of the common ink chamber to nozzles through pressure chambers respectively, the pressure chambers being arranged along a plane to thereby classify the plurality of individual ink flow paths into first individual ink flow paths in which the common ink chamber is opposite to the pressure chambers and second individual ink flow paths in which the common ink chamber is not opposite to the pressure chambers; and an actuator unit fixed to a surface of the flow path unit for changing the volume of each of the pressure chambers. Adjustment portions having an effect of adjusting compliance of the pressure chambers are provided in the flow path unit at a side opposite to the actuator unit with respect to the pressure chambers so that compliance of the pressure chambers corresponding to the first individual ink flow paths is equalized to compliance of the pressure chambers corresponding to the second individual ink flow paths.

According to this configuration, the difference in compliance between the pressure chambers due to the difference in positional relation between each pressure chamber and the common ink chamber can be compensated for so that the speed of ink ejected from nozzles can be made uniform.

In the embodiment, the plurality of individual ink flow paths different in the positional relation are classified into two types, namely, the type in which the common ink chamber is opposite to the pressure chambers and the type in which the common ink chamber is not opposite to the pressure chambers, and the adjustment portions may be provided so as to correspond to only the individual ink flow paths of the type in which the common ink chamber is not opposite to the pressure chambers. Or, in the embodiment, the adjustment portions may be provided so as to correspond to only the second individual ink flow paths among the first and second individual ink flow paths. According to this configuration, the structure can be simplified.

In the embodiment, the plurality of individual ink flow paths different in the positional relation are classified into two types, namely, the type in which the common ink chamber is opposite to the pressure chambers and the type in which the common ink chamber is not opposite to the pressure chambers, and the adjustment portions may be provided so as to correspond to the two types of individual ink flow paths. Or, in the embodiment, the adjustment portions may be provided so as to correspond to the first and second individual ink flow paths. According to this configuration, the compliance adjusting effect of the adjustment portions can be set suitably.

In this case, it is preferable from the point of view of adjusting compliance of each pressure chamber accurately that the adjustment portions provided so as to correspond to the individual ink flow paths of the type in which the common ink chamber is not opposite to the pressure chambers are larger in size than the adjustment portions provided so as to correspond to the individual ink flow paths of the type in which the common ink chamber is opposite to the pressure chambers.

In the embodiment, the adjustment portions may be similar in shape to the pressure chambers. According to this configuration, compliance of each pressure chamber can be adjusted without necessity of reducing the total rigidity of the flow path unit to a lower value than required.

In the embodiment, the adjustment portions may increase compliance of the pressure chambers. According to this configuration, compliance of each pressure chamber can be adjusted easily.

In this case, it is preferable from the point of view of facilitating production that the adjustment portions are voids. In this case, it is further preferable that the adjustment portions communicate with the atmospheric air. This is because the air in the voids flows out to the outside when the voids are compressed, that is, because the possibility that the voids may be broken by vibration generated in the pressure chambers can be reduced. When the adjustment portions communicate with the atmospheric air, it is preferable from the point of view of simplifying the structure that the adjustment portions are connected to one another.

In the embodiment, it is preferable that the adjustment portions are arranged opposite to the pressure chambers. According to this configuration, compliance can be adjusted efficiently.

In this configuration, it is preferable that a sectional area of the adjustment portions are configured to be constant along a direction that the common ink flow paths extends.

In a further aspect, the inkjet printing head according to the embodiment includes: a flow path unit including a plurality of individual ink flow paths formed to have pressure chambers respectively; and an actuator unit fixed to a surface of the flow path unit for changing the volume of each of the pressure chambers. The flow path unit further includes: a plurality of nozzles for ejecting ink; a plurality of pressure chamber columns which extend in parallel to one another and each of which is constituted in such a manner that the plurality of pressure chambers each having a substantially quadrilateral flat shape having two acute-angled portions diagonally are arranged so as to be adjacent to one another while connected to nozzles respectively; and first and second common ink flow paths extending in parallel to each other in a direction parallel to the plurality of pressure chamber columns. The plurality of pressure chamber columns have: first pressure chamber columns each constituted by a plurality of first pressure chambers each of which has one acute-angled portion connected to the first common ink flow path, and the other acute-angled portion connected to a first nozzle; second pressure chamber columns each constituted by a plurality of second pressure chambers each of which has one acute-angled portion adjacent to the other acute-angled portion of the first pressure chamber, opposite to the first pressure chamber and connected to the first common ink flow path, and the other acute-angled portion connected to a second nozzle; third pressure chamber columns each constituted by a plurality of third pressure chambers each of which has one acute-angled portion adjacent to the other acute-angled portion of the second pressure chamber, opposite to the second pressure chamber and connected to a third nozzle, and the other acute-angled portion connected to the second common ink flow path; and fourth pressure chamber columns each constituted by a plurality of fourth pressure chambers each of which has one acute-angled portion adjacent to the other acute-angled portion of the third pressure chamber, opposite to the third pressure chamber and connected to a fourth nozzle, and the other acute-angled portion connected to the second common ink flow path. Adjustment portions having an effect of adjusting compliance of the pressure chambers are provided in the flow path unit at a side opposite to the actuator unit with respect to the pressure chambers so as to be arranged along the second and third pressure chamber columns respectively so that compliance of the first to fourth pressure chambers is equalized.

In the inkjet printing head, the adjustment portions may be provided along the first, second, third and fourth pressure chamber columns respectively. According to this configuration, the compliance adjusting effect of the adjustment portions can be set suitably.

Figure 14:
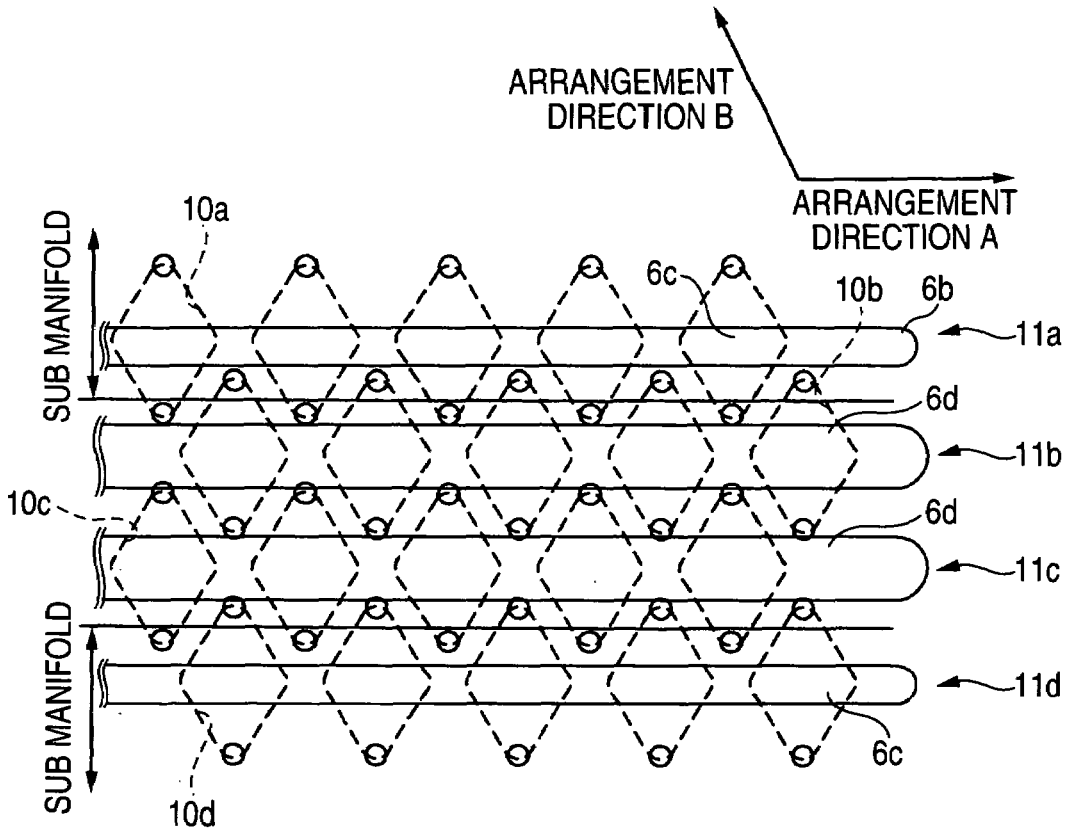
FIG. 14 is a plan view of the base plate according to a fourth embodiment.

In the embodiment, as shown in FIG. 14, a sectional area of the adjustment portions may be configured to be constant along a direction that the common ink flow paths extends. According to this configuration, the adjustment portions become easily formed.

In FIG. 14, it is shown a configuration that the adjustment portions are provided to extend in a direction parallel to an extending direction of the common ink chamber. In the configuration shown in FIG. 14, each of the adjustment portions may be voids having a constant sectional shape and size.

Figure 15:
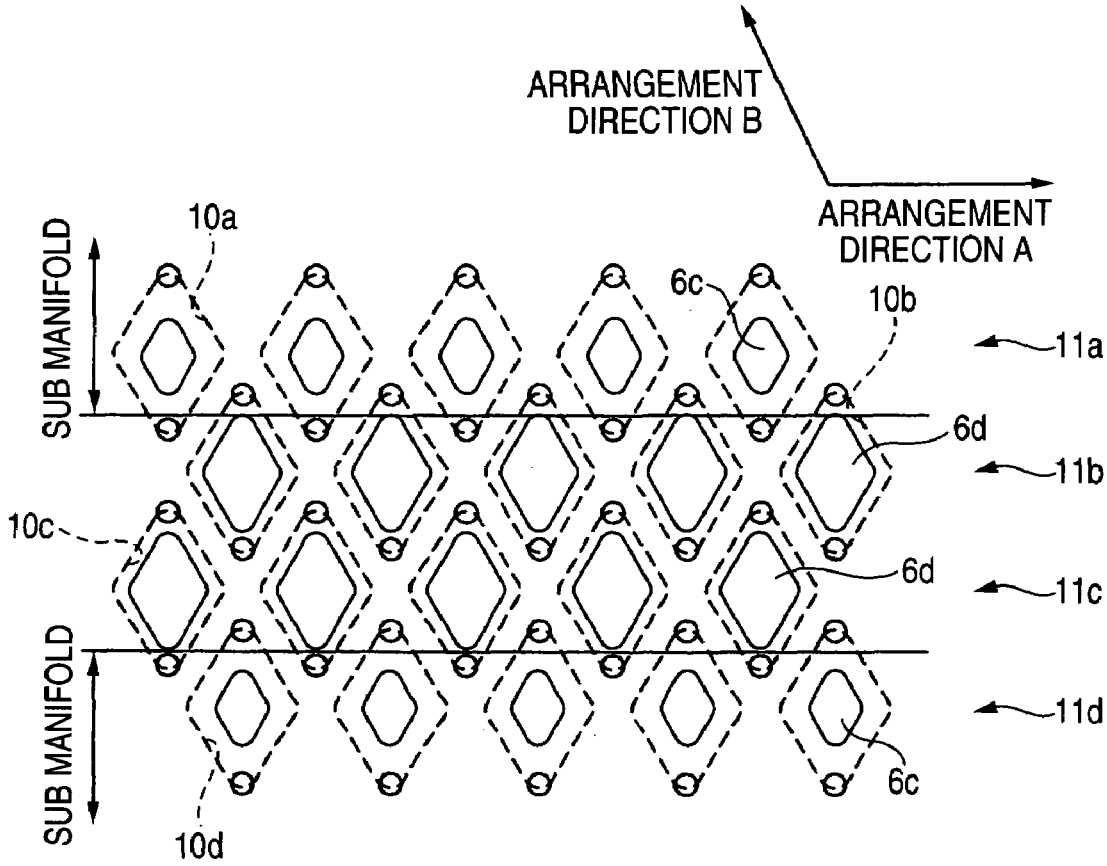
FIG. 15 is a plan view of the base plate according to a fifth embodiment.

In the embodiment, as shown in FIG. 15, each of the adjustment portions may be provided individually.

In the embodiment, the plurality of individual ink flow paths are classified into two types. However, in the inkjet printing head, the individual ink flow paths may be classified into a plurality of types in accordance with facing area between the pressure chambers thereof and the common ink chamber. In this case, the adjustment portions should be provided in different sectional structure for each of the respective pressure chambers with respect to each of the types of the individual ink flow paths in which the respective pressure chambers are included.

In the embodiments described above, the individual ink flow paths are classified into two types of the type in which the common ink chamber is opposite to the pressure chambers and the type in which the common ink chamber is not opposite to the pressure chambers. However, as shown in FIGS. 16A and 16B, the individual ink flow paths may be configured so as to be classified into a plurality of types having different facing area between the pressure chambers thereof and the common ink chamber.

Figure 16A:
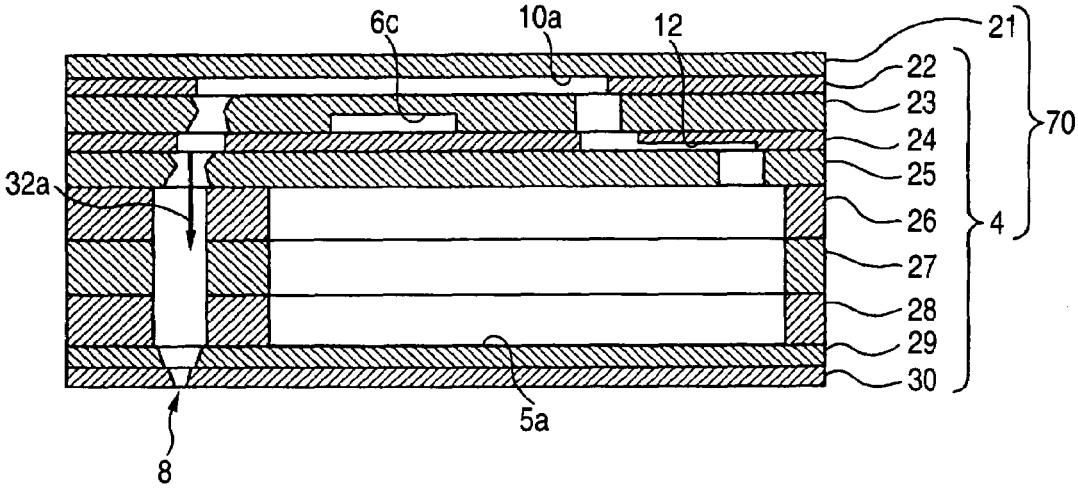
FIGS. 16A and 16B are sectional views showing a head body of an inkjet printing head according to a sixth embodiment.
Figure 16B:
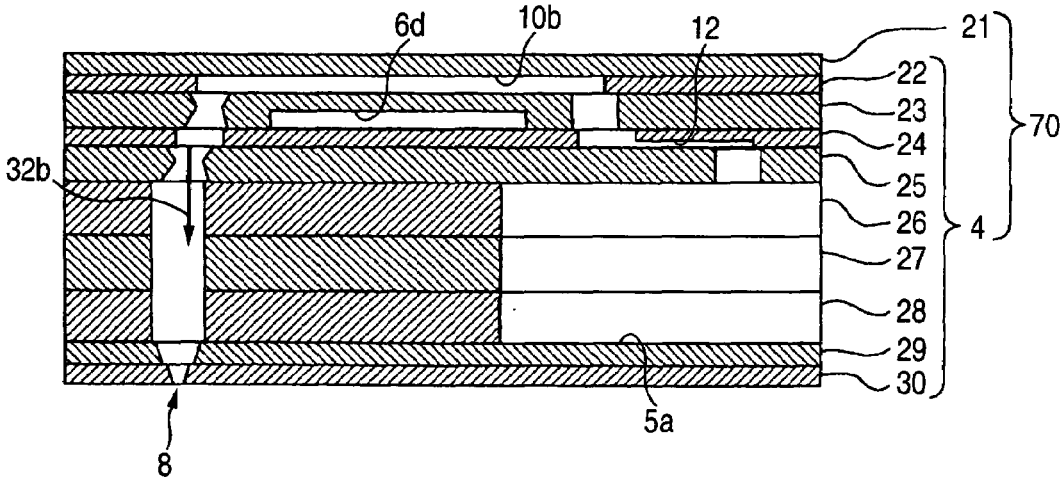

In the configuration shown in FIGS. 16A and 16B, in order to adjust the compliances of each of the pressure chambers provided in each of the types of individual ink flow paths, an area of the adjustment portions for one of the types of the individual ink flow paths may be configured to be smaller than an area of the adjustment portions for other types of the individual ink flow paths having smaller facing area.

In the configuration shown in FIGS. 16A and 16B, in order to adjust the compliances of each of the pressure chambers provided in each of the types of individual ink flow paths, the adjustment portions may be exclusively provided for the individual ink flow paths of type having smallest facing area.

In the configuration shown in FIGS. 16A and 16B, in order to adjust the compliances of each of the pressure chambers provided in each of the types of individual ink flow paths, areas of the adjustment portions provided for the individual ink flow paths of each type may be configured to be smaller than areas of the adjustment portions provided for the individual ink flow paths of types having larger facing areas.

In the configuration shown in FIGS. 16A and 16B, in order to adjust the compliances of each of the pressure chambers provided in each of the types of individual ink flow paths, an area of the adjustment portions for the individual ink flow paths of a type in which a center of the pressure chambers thereof overlaps to the common ink chamber, may be configured to be smaller than an area of the adjustment portions for the individual ink flow paths of other types.

In the configuration shown in FIGS. 16A and 16B, in order to adjust the compliances of each of the pressure chambers provided in each of the types of individual ink flow paths, the adjustment portions may be exclusively provided for the individual ink flow paths of the type in which the center of the pressure chambers thereof overlaps to the common ink chamber.

Figure 17A:
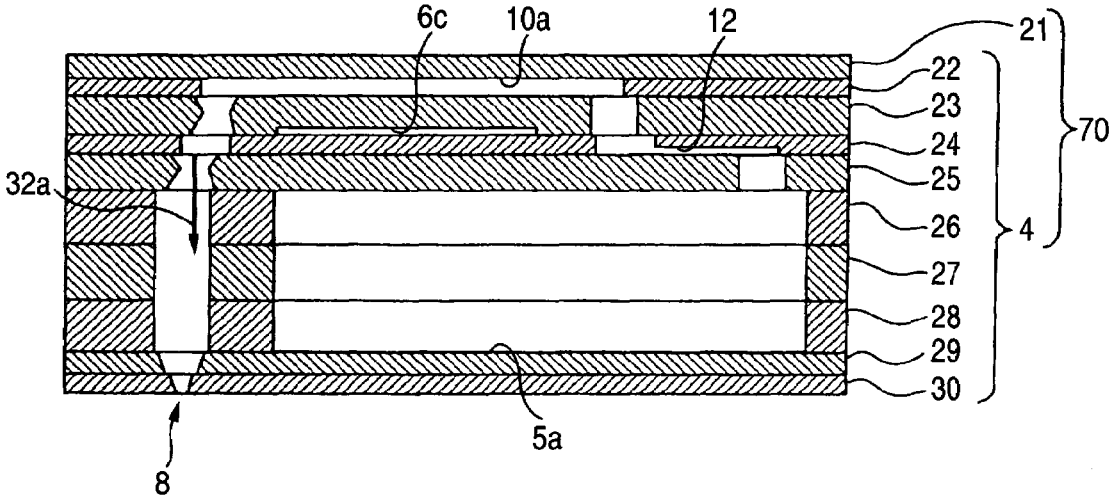
FIGS. 17A and 17B are sectional views showing a head body of an inkjet printing head according to a seventh embodiment.
Figure 17B:
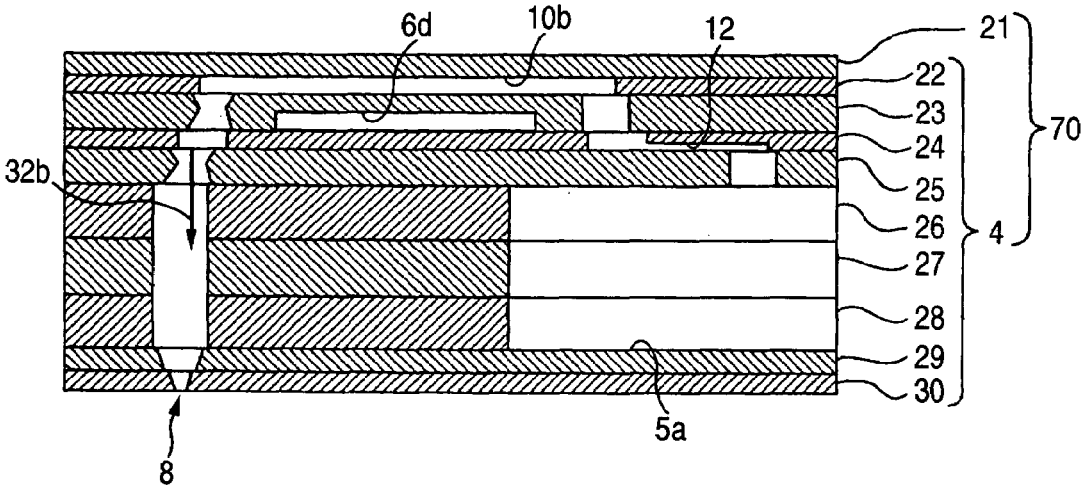

As another configuration for adjusting the compliances of each of the pressure chambers in an inkjet printing head having the individual ink flow paths classified into a plurality of types having different facing area between the pressure chambers thereof and the common ink chamber, as shown in FIGS. 17A and 17B, a thickness of the flow path unit between the adjustment portions and the respective pressure chambers may be configured to be thicker in accordance with the size of the facing area.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printing head comprising:

an actuator unit; and a flow path unit onto whose surface the actuator unit is fixed, the flow path unit including:

a common ink chamber having a plurality of outlets, the common ink chamber being provided at a side opposite to the actuator unit with respect to a plurality of pressure chambers;

a plurality of individual ink flow paths having the plurality of pressure chambers of which the volumes are changed by the actuator unit, the individual ink flow paths for leading ink from the respective outlets of the common ink chamber to respective nozzles through respective pressure chambers, the pressure chambers arranged along a plane in a form of matrix and each connected to the respective nozzles, the individual ink flow paths being classified into a plurality of types in accordance with facing area between the pressure chambers thereof and the common ink chamber; and a plurality of adjustment portions provided at a side opposite to the actuator unit with respect to the pressure chambers and adjust compliances of each of the pressure chambers belonging to the classified types of the individual ink flow paths to be equalized.

2. The inkjet printing head according to claim 1, wherein the adjustment portions are provided in different sectional structure for each of the respective pressure chambers with respect to each of the types of the individual ink flow paths in which the respective pressure chambers are included.

3. The inkjet printing head according to claim 2, wherein an area of the adjustment portions for one of the types of the individual ink flow paths is configured to be smaller than an area of the adjustment portions for other types of the individual ink flow paths having smaller facing area.

4. The inkjet printing head according to claim 3, wherein the adjustment portions are exclusively provided for the individual ink flow paths of type having smallest facing area.

5. The inkjet printing head according to claim 3, wherein areas of the adjustment portions provided for the individual ink flow paths of each type are configured to be smaller than areas of the adjustment portions provided for the individual ink flow paths of types having larger facing areas.

6. The inkjet printing head according to claim 2, wherein an area of the adjustment portions for the individual ink flow paths of a type in which a center of the pressure chambers thereof overlaps to the common ink chamber, is configured to be smaller than an area of the adjustment portions for the individual ink flow paths of other types.

7. The inkjet printing head according to claim 6, wherein the adjustment portions are exclusively provided for the individual ink flow paths of the type in which the center of the pressure chambers thereof does not overlap to the common ink chamber.

8. The inkjet printing head according to claim 2, wherein a thickness of the flow path unit between the adjustment portions and the respective pressure chambers is configured to be thicker in accordance with the size of the facing area.

9. The inkjet printing head according to claim 1, wherein the individual ink flow paths are classified into two types including a first type, in which the pressure chambers thereof are disposed at positions opposite to the common ink chamber, and a second type, in which the pressure chambers thereof are disposed at positions deviated from positions which are opposites to the common ink chamber.

10. The inkjet printing head according to claim 9, wherein the adjustment portions are exclusively provided at positions that correspond to the individual ink flow paths of the second type.

11. The inkjet printing head according to claim 9, wherein the adjustment portions are provided at positions that correspond to the individual ink flow paths of both of the first and second type.

12. The inkjet printing head according to claim 11, wherein the adjustment portions provided at positions that correspond to the individual ink flow paths of the second type are configured to be larger in size than the adjustment portions provided at positions that correspond to the individual ink flow paths of the first type.

13. The inkjet printing head according to claim 9, wherein the adjustment portions are configured to adjust compliances of the pressure chambers of the individual ink flow paths of a first type to be equalized to compliances of the pressure chambers of the individual ink flow paths of a second type.

14. The inkjet printing head according to claim 13, wherein the adjustment portions are exclusively provided at positions that correspond to the individual ink flow paths of the second type.

15. The inkjet printing head according to claim 13, wherein the adjustment portions are provided at positions that correspond to the individual ink flow paths of both of the first and second type.

16. The inkjet printing head according to claim 1, wherein the adjustment portions are configured to be similar in shape to the pressure chambers.

17. The inkjet printing head according to claim 1, wherein the adjustment portions adjust the compliances of the pressure chambers by increasing the compliance of the pressure chambers having low compliance.

18. The inkjet printing head according to claim 17, wherein the adjustment portions are voids.

19. The inky et printing head according to claim 18, wherein the adjustment portions are configured to be communicated with atmospheric air.

20. The inkjet printing head according to claim 19, wherein the adjustment portions are connected to one another.

21. The inky et printing head according to claim 20, wherein a sectional area of the adjustment portions are configured to be constant along a direction that the common ink flow paths extends.

22. The inkjet printing head according to claim 1, wherein the adjustment portions are provided at positions opposite to the pressure chambers.

23. The inkjet printing head according to claim 1, wherein the flow path unit further includes a plurality of nozzles for ejecting ink, which are classified into four groups of a first through fourth nozzles, wherein each of the pressure chambers are formed in a substantially quadrilateral flat shape having acute-angled portions diagonally, one of which is connected to one of the nozzles, and the pressure chambers are aligned in columns of a first through fourth pressure chamber columns extending in parallel to one another, wherein the common ink chamber includes first and second common ink flow paths extending in parallel to each other in a direction parallel to the pressure chamber columns, wherein in the pressure chambers included in the first pressure chamber column, one of the acute-angled portions is connected to the first common ink flow path and the other of the acute-angled portions is connected to one of the first nozzles, wherein in the pressure chambers included in the second pressure chamber column, one of the acute-angled portions that is adjacent to the one of the acute-angled portions in the first pressure chamber column and opposed to the pressure chambers of the first pressure chamber column, is connected to the first common ink flow path and the other of the acute-angled portions is connected to one of the second nozzles, wherein in the pressure chambers included in the third pressure chamber column, one of the acute-angled portions that is adjacent to the other of the acute-angled portions in the second pressure chamber column and opposed to the pressure chambers of the second pressure chamber column, is connected to one of the third nozzles and the other of the acute-angled portions is connected to the second common ink flow path, wherein in the pressure chambers included in the fourth pressure chamber column, one of the acute-angled portions that is adjacent to the other of the acute-angled portions in the third pressure chamber column and opposed to the pressure chambers of the third pressure chamber column, is connected to one of the fourth nozzles and the other of the acute-angled portions is connected to the second common ink flow path, and wherein the adjustment portions are provided along each of the second and third pressure chamber columns respectively.

24. The inkjet printing head according to claim 23, wherein the adjustment portions are provided along each of the first, second, third and fourth pressure chamber columns respectively.

25. The inkjet printing head according to claim 1, wherein a sectional area of the adjustment portions are configured to be constant along a direction that the common ink flow paths extends.

26. The inkjet printing head according to claim 1, wherein each of the adjustment portions are provided individually.

27. The inkjet printing head according to claim 1, wherein the flow path unit further includes a plurality of nozzles for ejecting ink, wherein each of the pressure chambers are formed in a substantially quadrilateral flat shape having acute-angled portions diagonally, one of which is connected to one of the nozzles, and the pressure chambers are aligned in columns extending in parallel to one another, wherein the common ink chamber includes a plurality of common ink flow paths extending in parallel to each other in a direction parallel to the pressure chamber columns, wherein the adjustment portions are provided along the pressure chamber columns.

28. The inkjet printing head according to claim 1, wherein the adjustment portions are provided to extend in a direction parallel to an extending direction of the common ink chamber.

29. The inkjet printing head according to claim 28, wherein each of the adjustment portions are voids having a constant sectional shape and size.

30. The inkjet printing head according to claim 1, wherein the flow path unit includes a plurality of plates laminated onto each other, and wherein the adjustment portions are formed through one or more of the plurality of plates.

31. The inkjet printing head according to claim 30, wherein the adjustment portions are formed through the plates including a plate that abuts to the pressure chambers.

32. An inkjet printing head comprising:

an actuator unit; and a flow path unit onto whose surface the actuator unit is fixed, the flow path unit including:

a plurality of nozzles for ejecting ink, which are classified into four groups of a first through fourth nozzles;

a common ink chamber having a plurality of outlets;

a plurality of individual ink flow paths having a plurality of pressure chambers of which the volumes are changed by the actuator unit, the individual ink flow paths for leading ink from the respective outlets of the common ink chamber to the respective nozzles through respective pressure chambers, the pressure chambers arranged along a plane in a form of matrix and each connected to the respective nozzles; and a plurality of adjustment portions provided at a side opposite to the actuator unit with respect to the pressure chambers and adjust compliances of each of the pressure chambers to be equalized, wherein each of the pressure chambers are formed in a substantially quadrilateral flat shape having acute-angled portions diagonally, one of which is connected to one of the nozzles, and the pressure chambers are aligned in columns of a first through fourth pressure chamber columns extending in parallel to one another, wherein the common ink chamber includes first and second common ink flow paths extending in parallel to each other in a direction parallel to the pressure chamber columns, wherein in the pressure chambers included in the first pressure chamber column, one of the acute-angled portions is connected to the first common ink flow path and the other of the acute-angled portions is connected to one of the first nozzles, wherein in the pressure chambers included in the second pressure chamber column, one of the acute-angled portions that is adjacent to the one of the acute-angled portions in the first pressure chamber column and opposed to the pressure chambers of the first pressure chamber column, is connected to the first common ink flow path and the other of the acute-angled portions is connected to one of the second nozzles, wherein in the pressure chambers included in the third pressure chamber column, one of the acute-angled portions that is adjacent to the other of the acute-angled portions in the second pressure chamber column and opposed to the pressure chambers of the second pressure chamber column, is connected to one of the third nozzles and the other of the acute-angled portions is connected to the second common ink flow path, wherein in the pressure chambers included in the fourth pressure chamber column, one of the acute-angled portions that is adjacent to the other of the acute-angled portions in the third pressure chamber column and opposed to the pressure chambers of the third pressure chamber column, is connected to one of the fourth nozzles and the other of the acute-angled portions is connected to the second common ink flow path, and wherein the adjustment portions are provided along each of the first, second, third and fourth pressure chamber columns respectively.

* * * * *